US007695297B2

(12) United States Patent
Pittenger et al.

(10) Patent No.: US 7,695,297 B2
(45) **Date of Patent: *Apr. 13, 2010**

(54) ELECTRICAL CONNECTOR WITH LATERALLY MOVING TERMINAL POSITION ASSURANCE (TPA) MEMBER

(75) Inventors: Joel A. Pittenger, Waterford, MI (US); Gregory D. Leece, Belleville, MI (US); Ralf Pfeilsticker, Novi, MI (US); Louis M. Carrer, Rockwood, MI (US); Jeffrey S. Campbell, West Bloomfield, MI (US); Franklin A. Holub, West Bloomfield, MI (US); Adam P. Tyler, Rochester Hills, MI (US); Adam Kennedy, Sandy, OR (US); Richard Kakkuri, Rochester Hills, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/387,498

(22) Filed: May 4, 2009

(65) Prior Publication Data

US 2009/0221167 A1 Sep. 3, 2009

Related U.S. Application Data

(60) Division of application No. 12/012,074, filed on Jan. 30, 2008, now Pat. No. 7,559,778, which is a continuation of application No. 11/527,784, filed on Sep. 26, 2006, now Pat. No. 7,361,036.

(60) Provisional application No. 60/727,094, filed on Oct. 14, 2005, provisional application No. 60/724,840, filed on Oct. 6, 2005.

(51) Int. Cl.
*H01R 13/62* (2006.01)

(52) U.S. Cl. ..... 439/157; 439/752

(58) Field of Classification Search ..... 439/752, 439/157

See application file for complete search history.

(56) References Cited

U.S. PATENT DOCUMENTS

| | | | | |
|---|---|---|---|---|
| 3,495,206 | A | 2/1970 | Pfister | 339/64 |
| 4,332,432 | A | 6/1982 | Colleran | 439/157 |
| 4,684,190 | A | 8/1987 | Clark et al. | 439/587 |

(Continued)

FOREIGN PATENT DOCUMENTS

| | | | |
|---|---|---|---|
| JP | 2005-174681 | A | 6/2005 |
| WO | WO-02/078126 | A2 | 10/2002 |

*Primary Examiner*—Tho D Ta
(74) *Attorney, Agent, or Firm*—Harrington & Smith

(57) ABSTRACT

An electrical connector including a housing; electrical contacts connected to the housing; and a mate assist system for assisting in mating the electrical connector to a mating electrical connector. The mate assist system includes a lever pivotably connected to the housing, a slider slidably connected to the housing, and a system for preventing unintentional movement of the lever from an unlocked position. The system for preventing unintentional movement of the lever includes a first latch adapted to be manually actuated by a user and a second latch on the slider adapted to be automatically moved by the mating electrical connector when the housing is initially mounted on the mating electrical connector. Both the first and second latches are moved to enable movement of the lever from the unlocked position.

22 Claims, 30 Drawing Sheets

U.S. PATENT DOCUMENTS

| | | | | |
|---|---|---|---|---|
| 5,244,400 | A | 9/1993 | Hatagishi | 439/157 |
| 5,269,696 | A | 12/1993 | Okada et al. | 439/140 |
| 5,556,304 | A | 9/1996 | Jinno | 439/595 |
| 5,564,935 | A | 10/1996 | Yagi et al. | 439/157 |
| 5,628,642 | A | 5/1997 | Bieringer et al. | 439/157 |
| 5,928,038 | A | 7/1999 | Berg et al. | 439/752 |
| 6,036,510 | A | 3/2000 | Ono et al. | 439/157 |
| 6,048,229 | A | 4/2000 | Lazaro, Jr. | 439/681 |
| 6,095,833 | A | 8/2000 | Osawa | 439/157 |
| 6,120,308 | A | 9/2000 | Hayashi | 439/157 |
| 6,305,990 | B1 | 10/2001 | Ward | 439/752 |
| 6,322,391 | B1 * | 11/2001 | Kodama | 439/595 |
| 6,345,995 | B1 | 2/2002 | Bigotto et al. | 439/157 |
| 6,361,378 | B1 | 3/2002 | Konoya et al. | 439/752 |
| 6,475,004 | B2 | 11/2002 | Shuey et al. | 439/157 |
| 6,514,098 | B2 | 2/2003 | Marpoe, Jr. et al. | 439/352 |
| 6,599,153 | B2 | 7/2003 | Nishide | 439/681 |
| 6,705,882 | B2 | 3/2004 | Casses | 439/157 |
| 6,796,836 | B2 | 9/2004 | Ichida et al. | |
| 6,811,451 | B2 | 11/2004 | Mase et al. | 439/752 |
| 6,899,554 | B1 | 5/2005 | Osada | 439/157 |
| 6,971,894 | B2 | 12/2005 | Dillon et al. | 439/157 |
| 7,201,615 | B2 * | 4/2007 | Kojima | 439/752 |
| 7,204,725 | B2 * | 4/2007 | Yamashita | 439/752 |
| 7,361,036 | B2 | 4/2008 | Pittenger et al. | 439/157 |
| 2001/0012710 | A1 | 8/2001 | Kumakura et al. | 439/157 |
| 2002/0022391 | A1 | 2/2002 | Beck, Jr. et al. | 439/157 |
| 2002/0061675 | A1 | 5/2002 | Borst | |
| 2002/0076992 | A1 * | 6/2002 | Kurimoto et al. | 439/752 |
| 2002/0081877 | A1 | 6/2002 | Ohnuki | 439/157 |
| 2002/0127912 | A1 | 9/2002 | Hamai et al. | 439/587 |
| 2002/0182908 | A1 | 12/2002 | Maegawa | 439/157 |
| 2003/0003786 | A1 | 1/2003 | Bakker et al. | 439/157 |
| 2004/0192090 | A1 | 9/2004 | Flowers et al. | 439/157 |
| 2005/0221647 | A1 | 10/2005 | Dillon et al. | 439/157 |
| 2005/0221653 | A1 | 10/2005 | Dillon | 439/331 |
| 2006/0040536 | A1 | 2/2006 | Putnam et al. | 439/157 |
| 2006/0089031 | A1 | 4/2006 | Flowers et al. | 439/157 |

* cited by examiner

ELECTRICAL CONNECTOR WITH LATERALLY MOVING TERMINAL POSITION ASSURANCE (TPA) MEMBER

CROSS REFERENCE TO RELATED APPLICATIONS

This application is a divisional application of application Ser. No. 12/012,074 filed Jan. 30, 2008, now U.S. Pat. No. 7,559,778, which is a continuation application of application Ser. No. 11/527,784 filed Sept. 26, 2006, now U.S. Pat. No. 7,361,036, which claims priority under 35 U.S.C. §119(e) on U.S. provisional patent application No. 60/727,094 filed Oct. 14, 2005, and U.S. provisional patent application No. 60/724,840 filed Oct. 6, 2005, which are hereby incorporated by reference in their entireties.

BACKGROUND OF THE INVENTION

1. Field of the Invention

The invention relates to an electrical connector and, more particularly, to an electrical connector with a lever.

2. Brief Description of Prior Developments

U.S. Pat. No. 6,705,882 discloses an electrical connector with a mating assistance device. A lever is used to assist in connecting the electrical connector to a mating electrical connector. Electrical connectors with a mating assistance device having a cam slider are also known. Electrical connectors with connector position assurance (CPA) members and terminal position assurance (TPA) members are also known. There is a desire to provide an electrical connector with various improvements over conventional electrical connectors.

SUMMARY OF THE INVENTION

In accordance with one aspect of the invention, an electrical connector is provided including a housing; electrical contacts connected to the housing; and a mate assist system for assisting in mating the electrical connector to a mating electrical connector. The mate assist system includes a lever pivotably connected to the housing, a slider slidably connected to the housing, and a system for preventing unintentional movement of the lever from an unlocked position. The system for preventing unintentional movement of the lever includes a first latch adapted to be manually actuated by a user and a second latch on the slider adapted to be automatically moved by the mating electrical connector when the housing is initially mounted on the mating electrical connector. Both the first and second latches are moved to enable movement of the lever from the unlocked position.

In accordance with another aspect of the invention, an electrical connector is provided comprising a housing; electrical contacts connected to the housing; and a lever and latch subassembly. The lever and latch subassembly comprises a lever pivotably mounted to the housing and a combined latch and connector position assurance (CPA) lock movably mounted on the lever. The combined latch and CPA lock comprises a latch portion and a blocking portion. The blocking portion is adapted to engage a portion of the housing to block movement of the lever on the housing from an unlocked position. The latch portion is adapted to latch the lever on the hosing at a locked position.

In accordance with another aspect of the invention, an electrical connector is provided comprising electrical contacts; a housing; a system for assisting mating of the electrical connector to a mating electrical connector; and a system for latching the lever at a predetermined location. The housing comprises a main section and a wire dress cover connected to the main section. The electrical contacts are connected to the main section. The wire dress cover is adapted to provide a cover for wires connected to the electrical contacts. The system for assisting mating comprises the lever. The system for latching the lever comprises a movable latch on the lever and a latch engaging portion on the wire dress cover.

In accordance with another aspect of the invention, an electrical connector housing assembly is provided comprising a main section; and a terminal position assurance (TPA) member movably connected to the main section at a bottom side of the main section. Electrical contacts are adapted to be inserted into the main section in a first direction. The TPA member is adapted to be moved in a second direction orthogonal to the first direction from an open position to a locked position on the main section.

In accordance with another aspect of the invention, an electrical connector is provided comprising electrical contacts; a housing having the electrical contacts connected thereto; and a system for assisting mating of the electrical connector to a mating electrical connector. The system for assisting mating comprises a lever pivotably connected to the housing and a slider slidably connected to the housing. The lever comprises an arm with two pivot pins. The slider comprises a pivot hole having a first one of the pivot pins pivotably located in the pivot hole. The slider comprises an elongate pivot pin slot having a second one of the pivot pins located in the slot for pivotable and slidable movement of the second pivot pin in the slot.

In accordance with another aspect of the invention, an electrical connector is provided comprising an electrical contact comprising a first connection section adapted to be attached to a wire and a second connection section having a general cage adapted to receive a male contact of a mating electrical connector; and a housing having the electrical contact connected thereto. The housing comprises a resilient cantilevered lock finger which is configured to slide along the cage while the electrical contact is being inserted into the housing and latch behind a rear edge of the cage to latch the electrical contact to the housing. The lock finger is sized and shaped to slide over a latching hole on a side of the cage to prevent premature latching of the lock finger with the cage at the latching hole before the lock finger latches behind the rear edge of the cage.

In accordance with another aspect of the invention, an electrical connector housing assembly is provided comprising a main housing member having a plurality of electrical contact receiving areas; and a terminal position assurance (TPA) member movably mounted to the main housing member. For each contact receiving area the TPA member comprises a male pin entry hole, a test probe entry hole, and a terminal service hole. For each contact receiving area the respective male pin entry hole and the test probe entry hole are aligned in a first direction on the TPA member and the respective terminal service hole is at least partially offset from the male pin entry hole and the test probe entry hole in the first direction.

In accordance with another aspect of the invention, an electrical connector housing assembly is provided comprising a main housing member having a plurality of electrical contact receiving areas; a mate assist system for assisting in connecting the main housing member to a mating electrical connector; and a mating electrical connector initial connection retainer system. The mate assist system comprises a slider movably mounted to the main housing member. The slider comprises a cam slot for receiving a cam pin of the mating electrical connector. The retainer system comprises the main housing member having an entry slot for receiving the cam pin. The cam slot and the entry slot are initially partially offset to form a restricted cam pin path. Before actuation of the mate assist system, when the electrical connector housing assembly is initially mounted on the mating electrical connector, the retainer system is adapted to frictionally trap the cam pin of the mating electrical connector between portions of the entry slot and the cam slot to initially retain the electrical connector housing assembly on the mating electrical connector until the mate assist system is actuated by a user.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
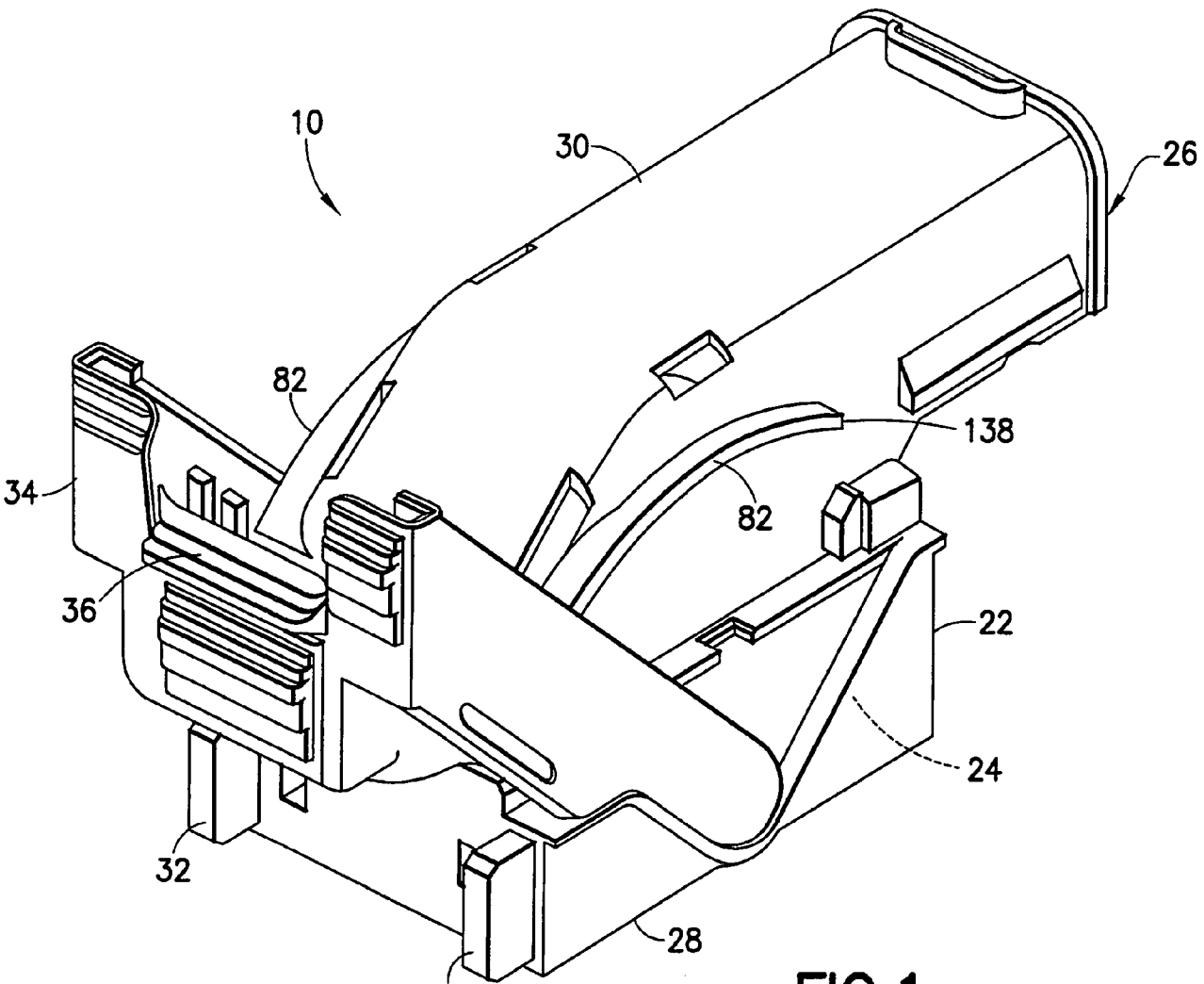
FIG. 1 is a perspective view of an electrical connector comprising features of the invention.
Figure 2:
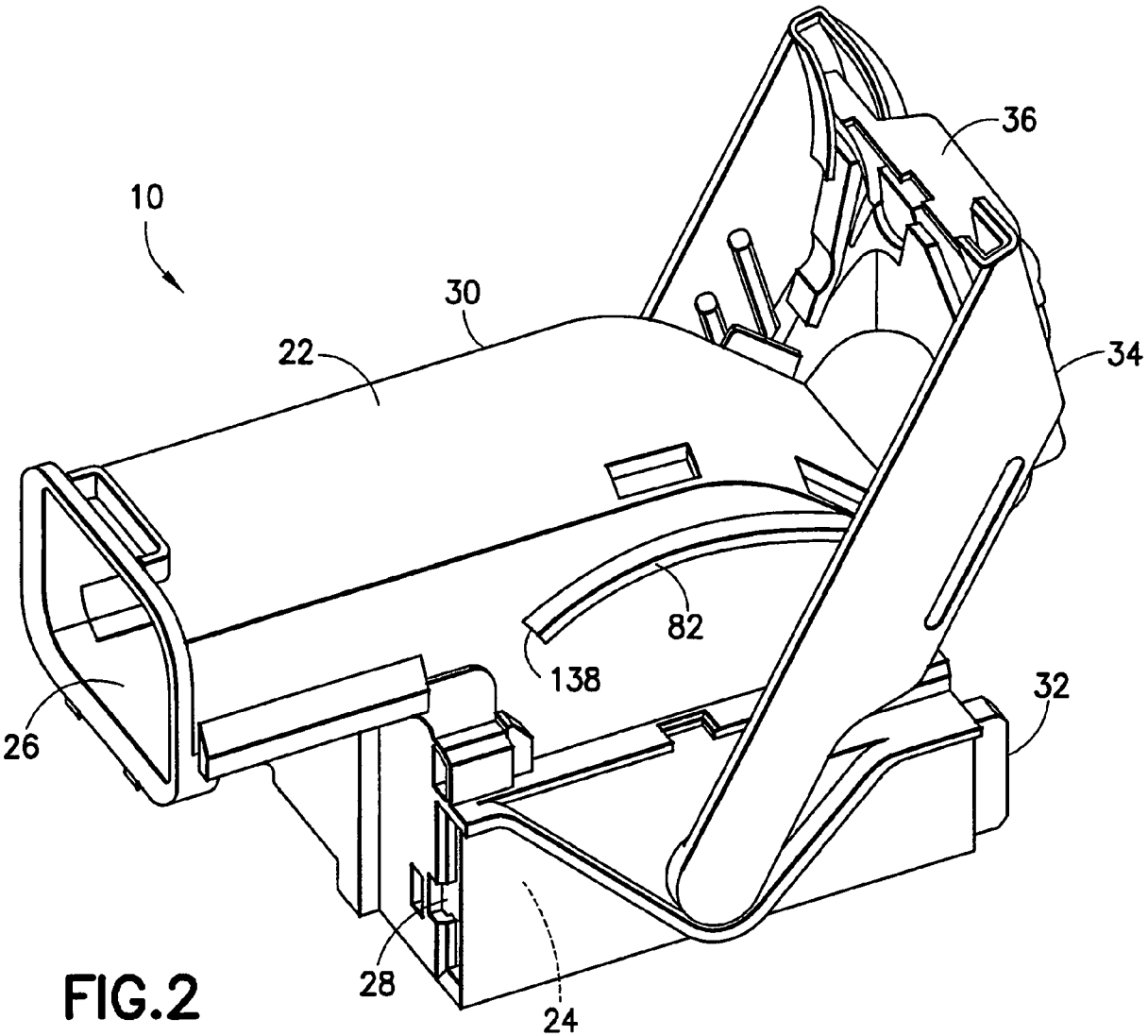
FIG. 2 is a perspective view of the electrical connector shown in FIG. 1 from another direction.
Figure 3:
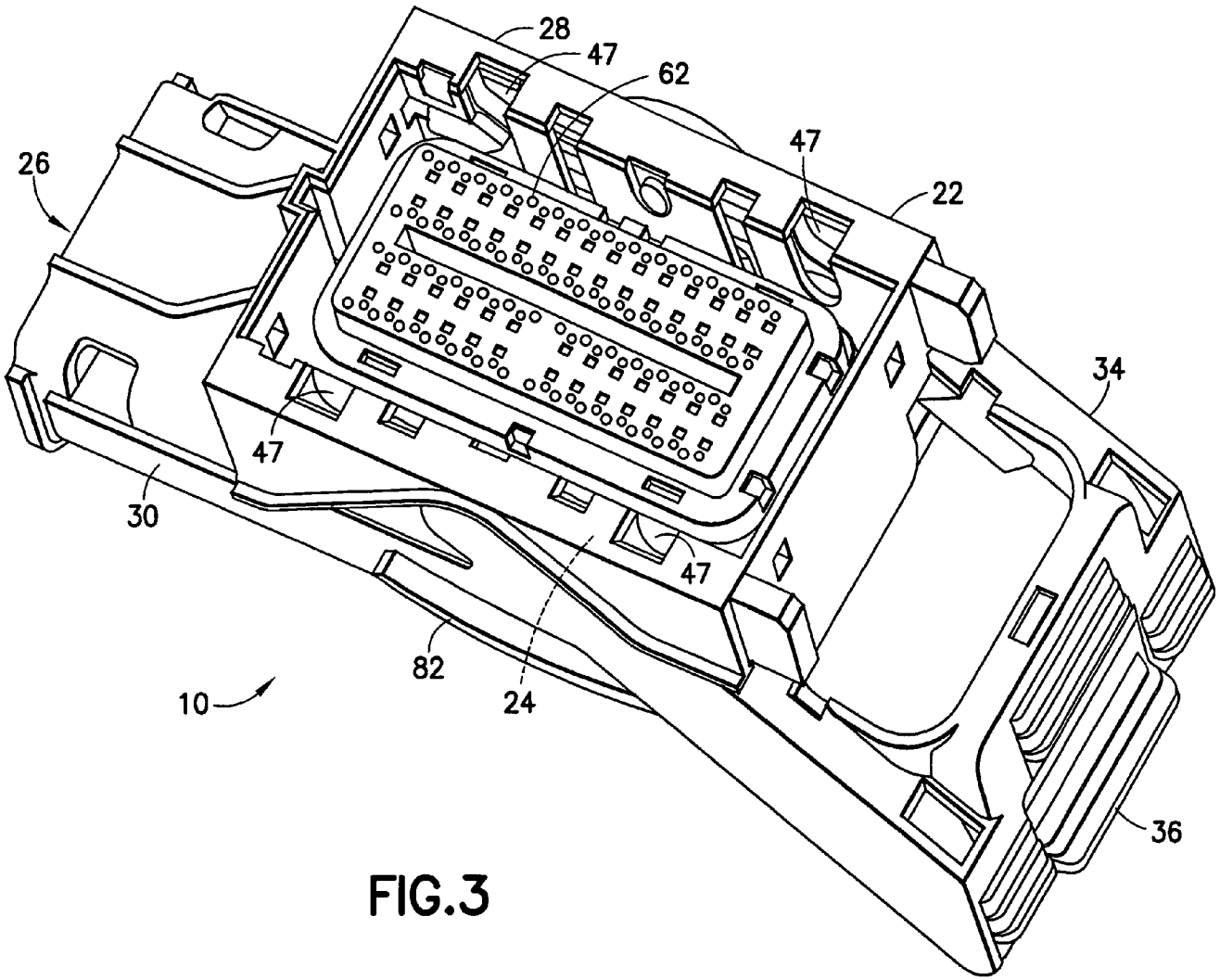
FIG. 3 is a perspective view of the electrical connector shown in FIG. 1 from another direction showing the bottom side of the connector.

Referring to FIGS. 1-3, there are shown perspective views of an electrical connector 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

Figure 24:
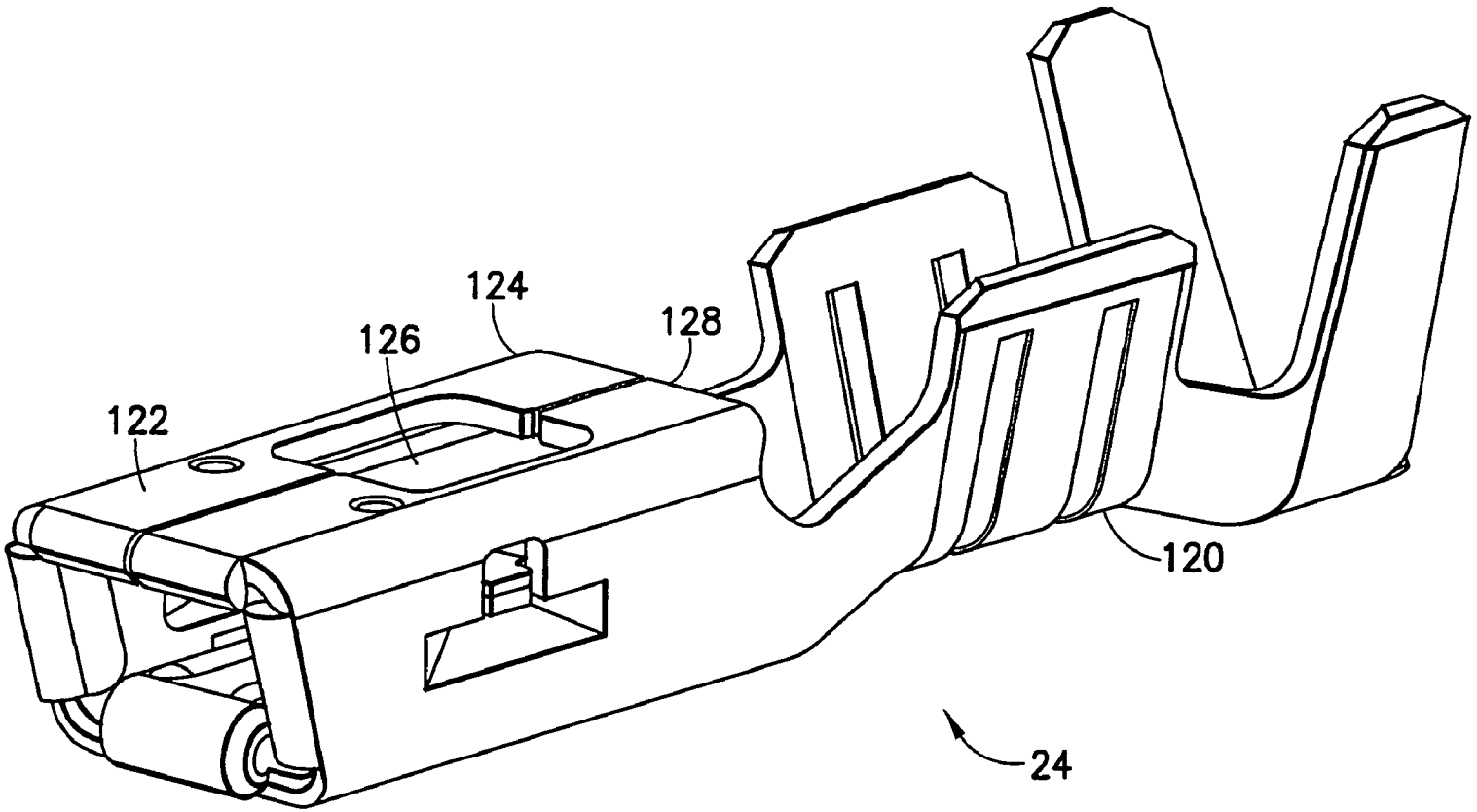
FIG. 24 is a perspective view of an electrical contact used in the electrical connector shown in FIG. 1.

The electrical connector 10 generally comprises a housing 22 and electrical contacts 24. The electrical contacts 24 are connected to electrical conductors (not shown) such as wires which extend out of an aperture at the rear end 26. Referring also to FIG. 24, the electrical contacts 24 are conventional electrical contacts. However, in alternate embodiments any suitable type of electrical contacts could be used. The electrical contacts 24 have a first connection section 120 adapted to be attached to a wire and a second connection section 122 having a general cage 124 adapted to removably receive a male pin contact of the mating electrical connector 12 (see FIGS. 15-18). A side of the cage 124 has a latching hole 126.

The latching hole 126 was designed for receiving a snap-lock latch of a housing. However, the latching hole 126 is not used in this embodiment. Instead, a rear edge 128 of the cage 124 is used to latch the electrical contact to the housing. After the contacts 24 are connected to their respective wires, the contacts 24 are inserted into contact receiving areas of the housing member 28 with the cages 124 pointed towards a bottom side of the housing and the first connection section extending towards the top side of the housing.

Figure 4:
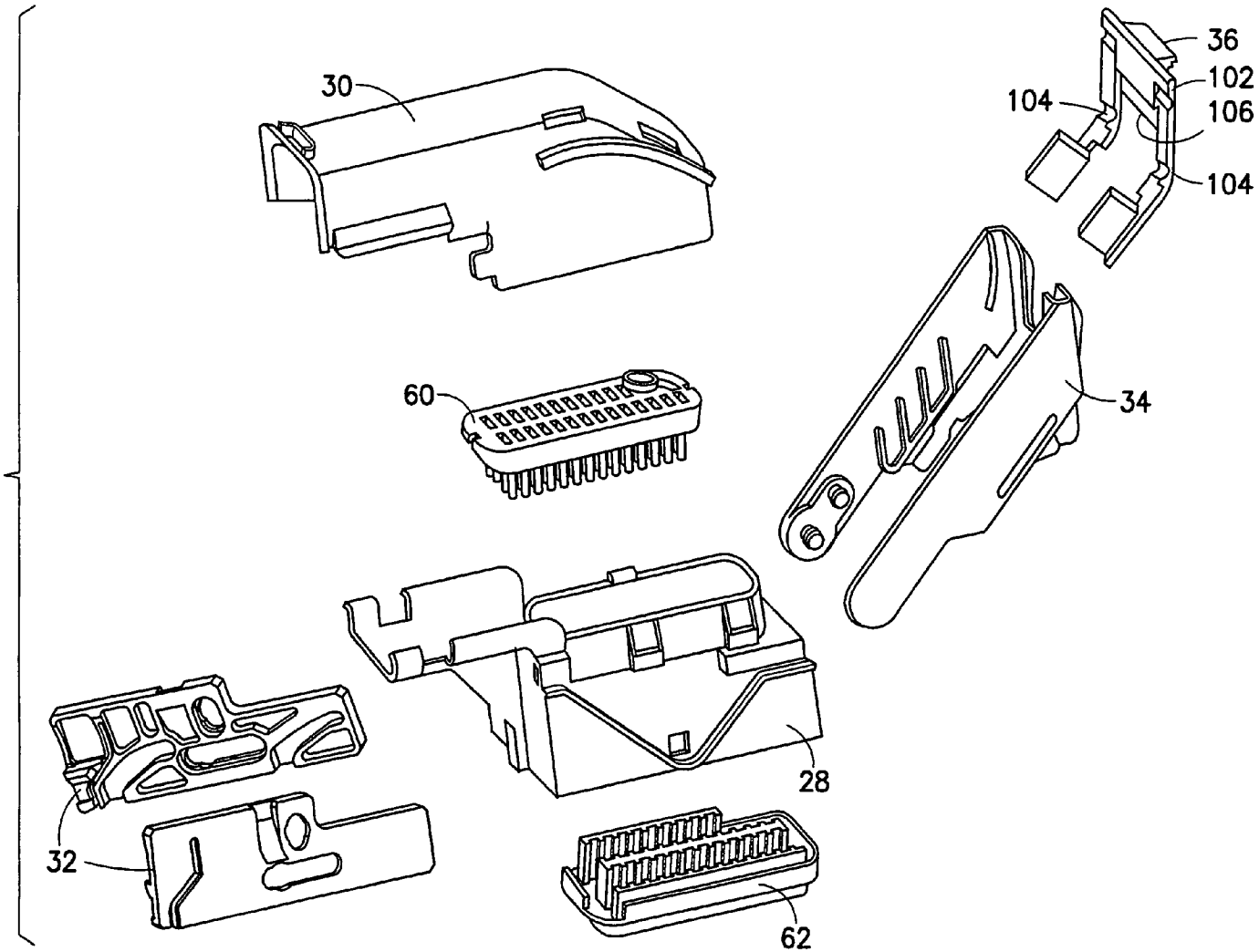
FIG. 4 is an exploded perspective view of the connector shown in FIG. 1.

Referring also to FIG. 4, the housing 22 generally comprises a first section or main section 28 and a wire dress cover 30. The connector 10 further comprises cam rods or sliders 32, a lever 34, a combined latch and connector position assurance (CPA) lock 36, a mat seal retainer 60, and a terminal position assurance (TPA) member 62. The first section 28 forms a main housing member for the electrical contacts 24.

Figure 5:
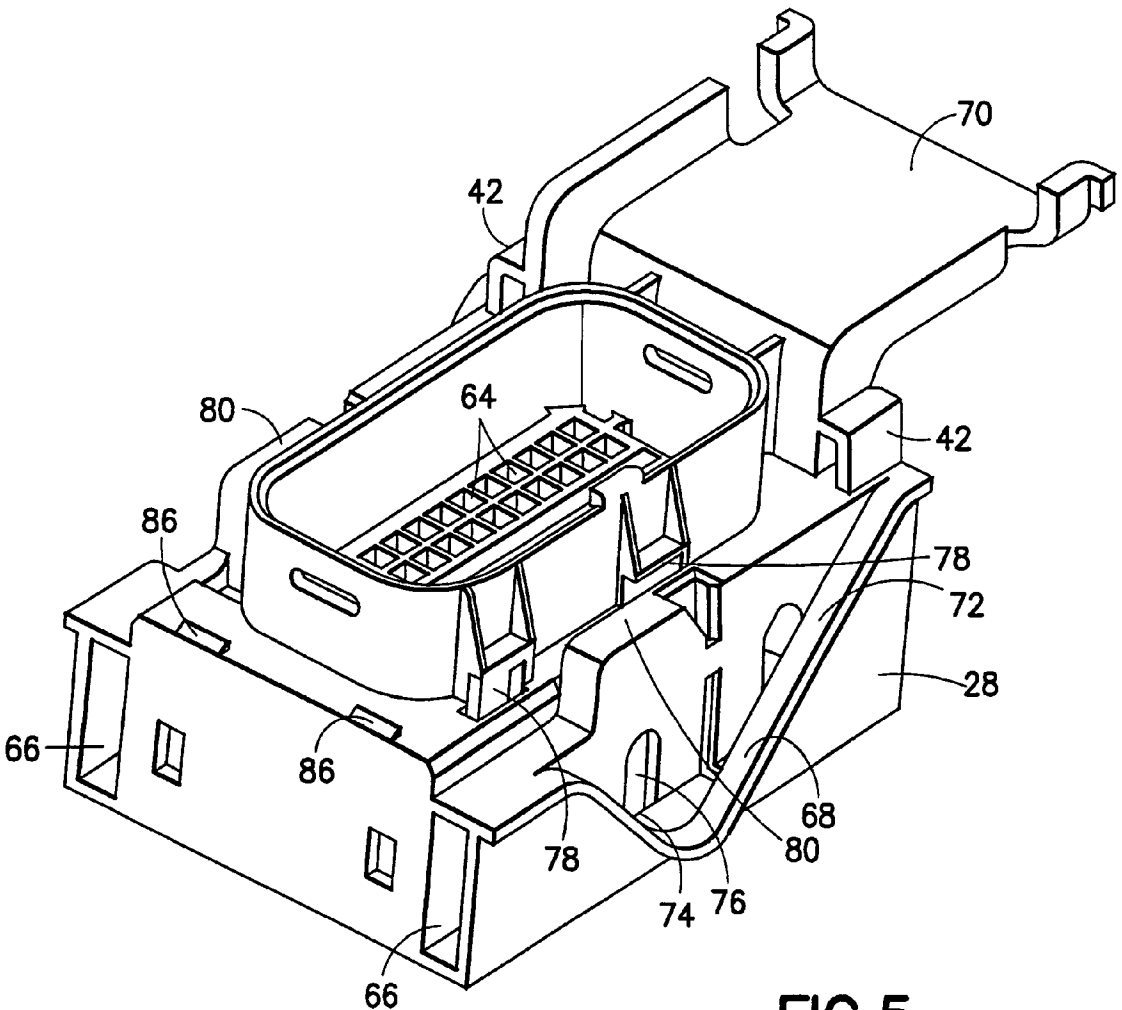
FIG. 5 is a top, front and side perspective view of a main housing member of the connector shown in FIG. 1.
Figures 5A, 5B:
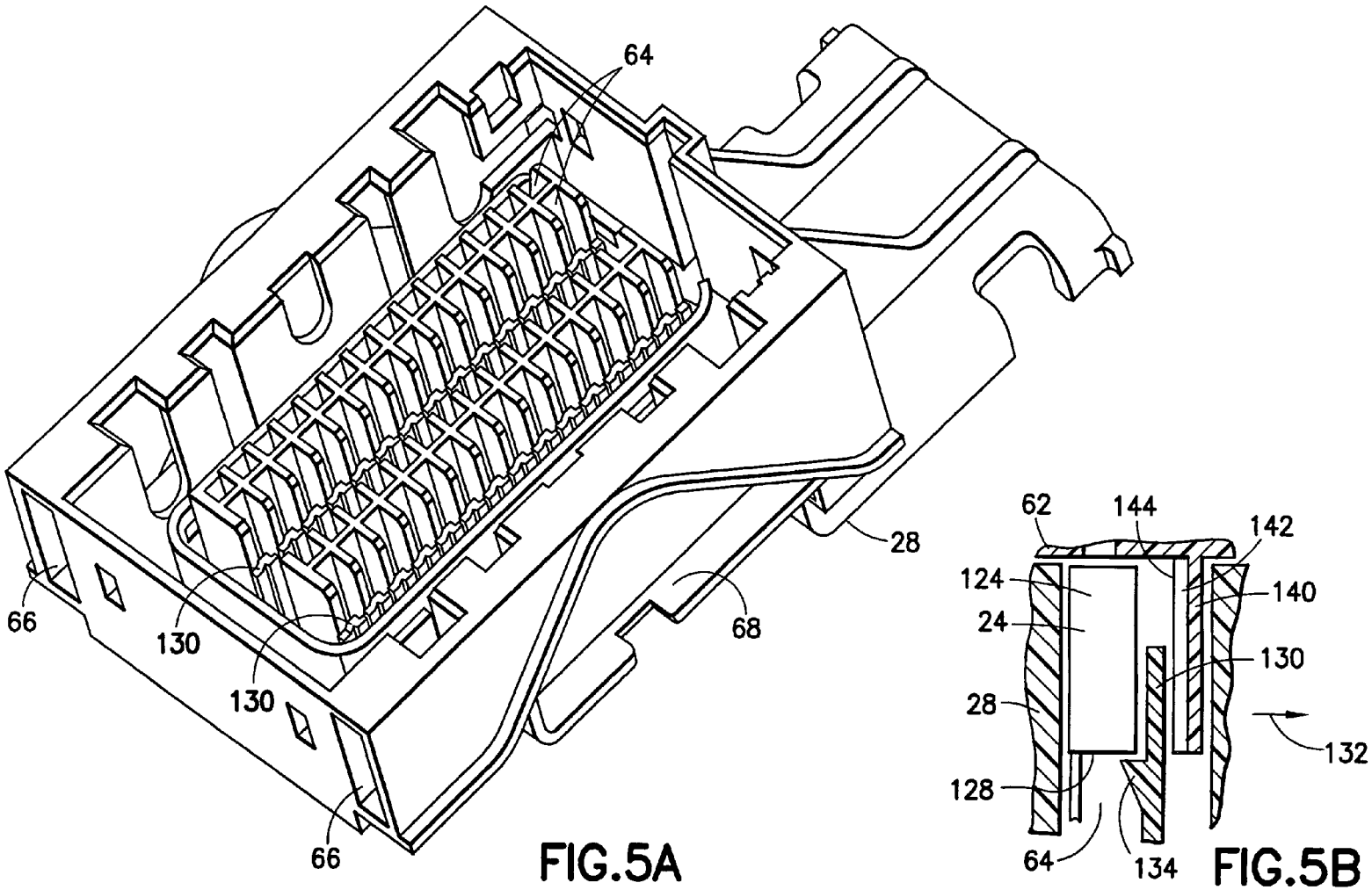
FIG. 5A is a bottom, front and side perspective view of the main housing member shown in FIG. 5.
FIG. 5B is a partial cross sectional view of the connector shown in FIG. 1.

Referring also to FIGS. 5, 5A and 5B, the first section 28 comprises a one-piece member made of molded plastic or polymer material. The first section 28 comprises contact receiving areas 64, cam rod receiving areas 66, lever arm receiving areas 68, and a cable conductor support surface 70. The contact receiving areas 64 are adapted to have the contacts 24 mounted therein. As seen best in FIG. 5B, for each receiving area 64, the housing 28 has a resilient, cantilevered lock finger 130. When the contact 24 is inserted into the receiving area 64 (assuming the TPA member 62 is in its unlocked or open position), the finger 130 resiliently deflects backwards as indicated by arrow 132 and the latch section 134 snaps back behind the rear edge 128. This captures the cage 124 between the latch section 134 and the TPA member 62. The lock finger 130 is configured to slide along the cage while the electrical contact is being inserted into the housing and latch behind the rear edge of the cage to latch the electrical contact to the housing. The lock finger 130 is sized and shaped to slide over the latching hole 126 on a side of the cage to prevent premature latching of the lock finger with the cage at the latching hole 126 before the lock finger latches behind the rear edge 128 of the cage.

The cam rod receiving areas 66 are provided on each lateral side of the first section 28. The cam rod receiving areas 66 form paths to allow the cam rods 32 to longitudinally side therein. The cam rod receiving areas 66 are located inward from the lever arm receiving areas 68. In this embodiment the cam rod receiving areas 66 have open front and rear ends. The lever arm receiving areas 68 are located on each lateral side of the first section 28.

The lever arm receiving areas 68 each have a general V shape with a rear sloped surface 72 and a front sloped surface 74. The top sides of the lever arm receiving areas 68 are generally open. The first section 28 also has pivot holes 76 located at inward sides of the cam rod receiving areas 66. The first section 28 also comprises cover retaining ledges 78 at the lateral sides of the first section 28 and opposing projections 80.

Figure 6:
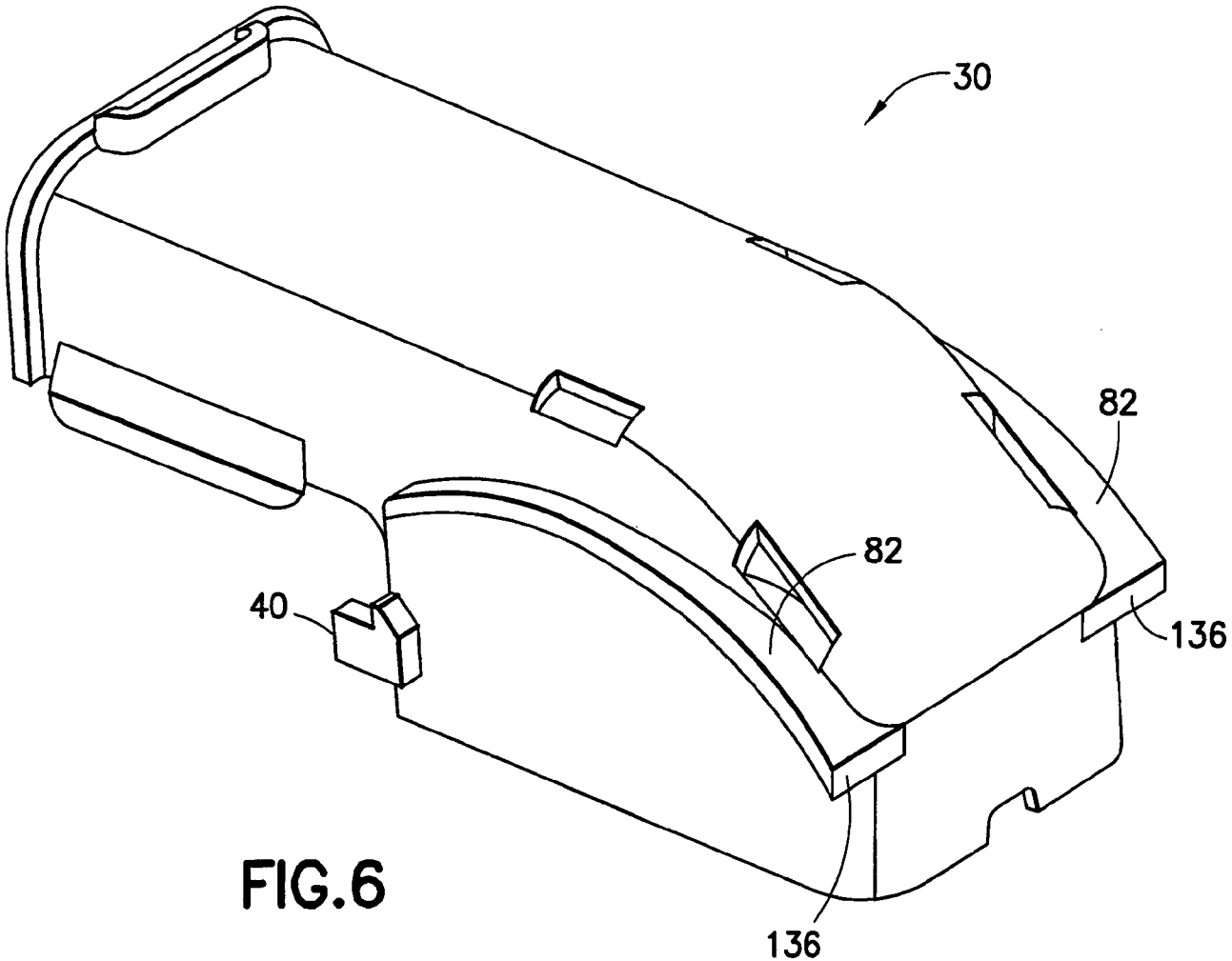
FIG. 6 is a top, front and side perspective view of the wire dress cover of the housing of the electrical connector shown in FIG. 1.
Figure 7:
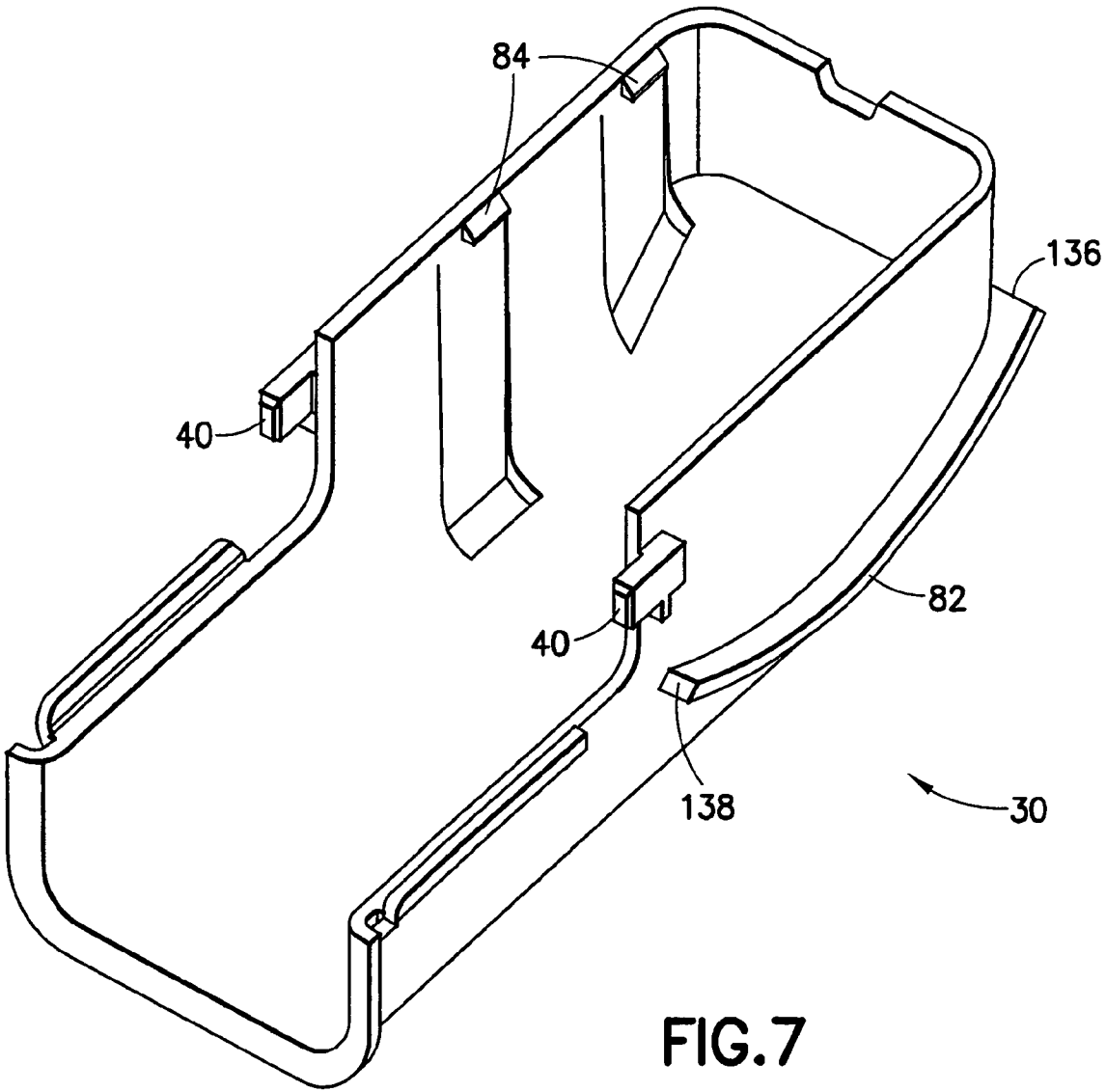
FIG. 7 is a bottom, rear and side perspective view of the wire dress cover shown in FIG. 6.

Referring also to FIGS. 6-7, the cover 30 is preferably a one-piece molded plastic or polymer member. In alternate embodiments, features of the cover could be provided on the first section 28 or in multiple alternative members. The cover 30 is adapted to be connected to the top side of the first section 28 to house extension of the conductor wires into the contact receiving areas 64 and into connection with the contacts 24. The mat seal retainer 60 is housed under the cover 30 and is adapted to make individual contact with each of the conductor wires of the cable. The cover 30 has two lateral sides. Each lateral side of the cover comprises an outward extending curved projection 82, inward extending mounting projections 84, and reward extending projections 40.

Figure 9:
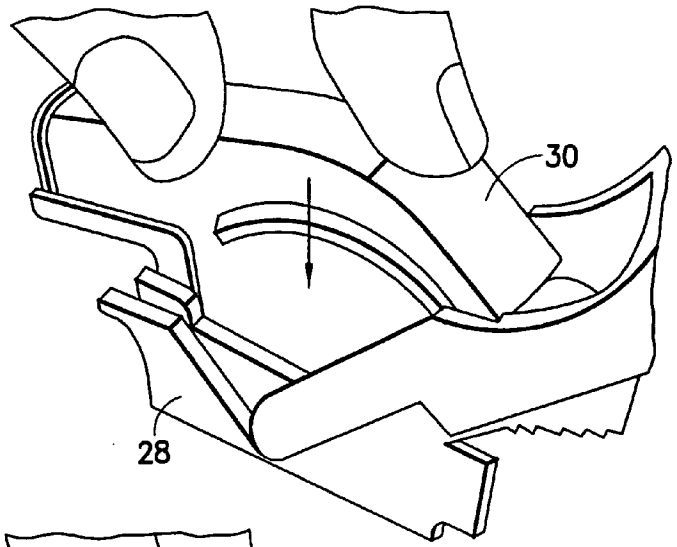
FIG. 9 is a perspective view showing a second step in connecting the wire dress cover of FIGS. 7-8 to the main housing member shown in FIGS. 5-5A.
Figure 10:
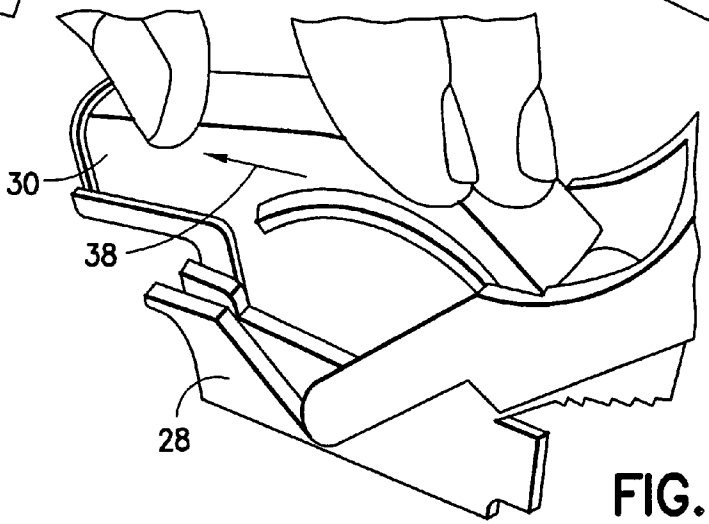
FIG. 10 is a perspective view showing a third step in connecting the wire dress cover of FIGS. 7-8 to the main housing member shown in FIGS. 5-5A.
Figure 8:
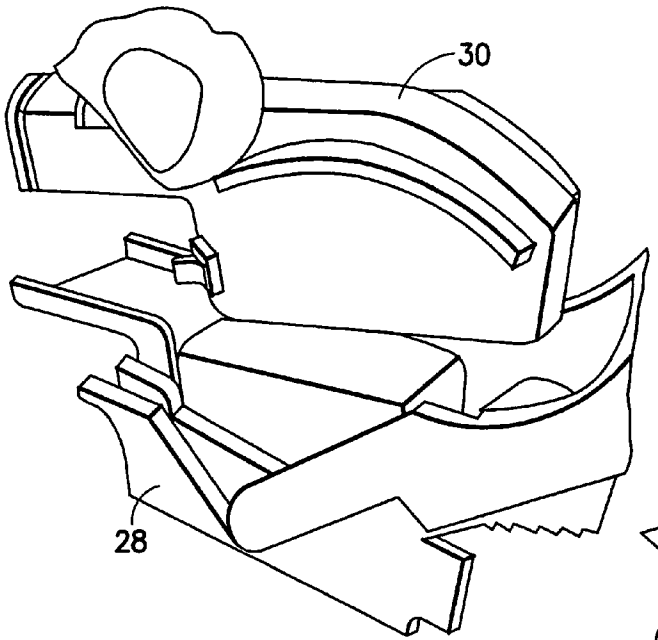
FIG. 8 is a perspective view showing a first step in connecting the wire dress cover of FIGS. 7-8 to the main housing member shown in FIGS. 5-5A.

Referring also to FIGS. 8-10, the cover 30 is preferably connected to the first section 28 by first lowering the cover 30 onto the top side of the first section as shown in FIGS. 8-9, and then sliding the cover 30 rearward as shown by arrow 38 in FIG. 10. The projections 40 extend into the channel sections 42 of the first section 28. Portions of the lateral sides of the cover 30 are located between the projections 80 and the cover retaining ledges 78 on the first section 28. The inward extending mounting projections 84 extend under the cover retaining ledges 78. The first section 28 also comprises snap-lock portions 86. The front of the cover 30 snaps behind the snap-lock portions 86. Top down positioning and slide action latching of the cover 30 to the first section 28 resists conductor wire pinching. However, in alternate embodiments, other types of housing configurations could be provided.

Figure 11:
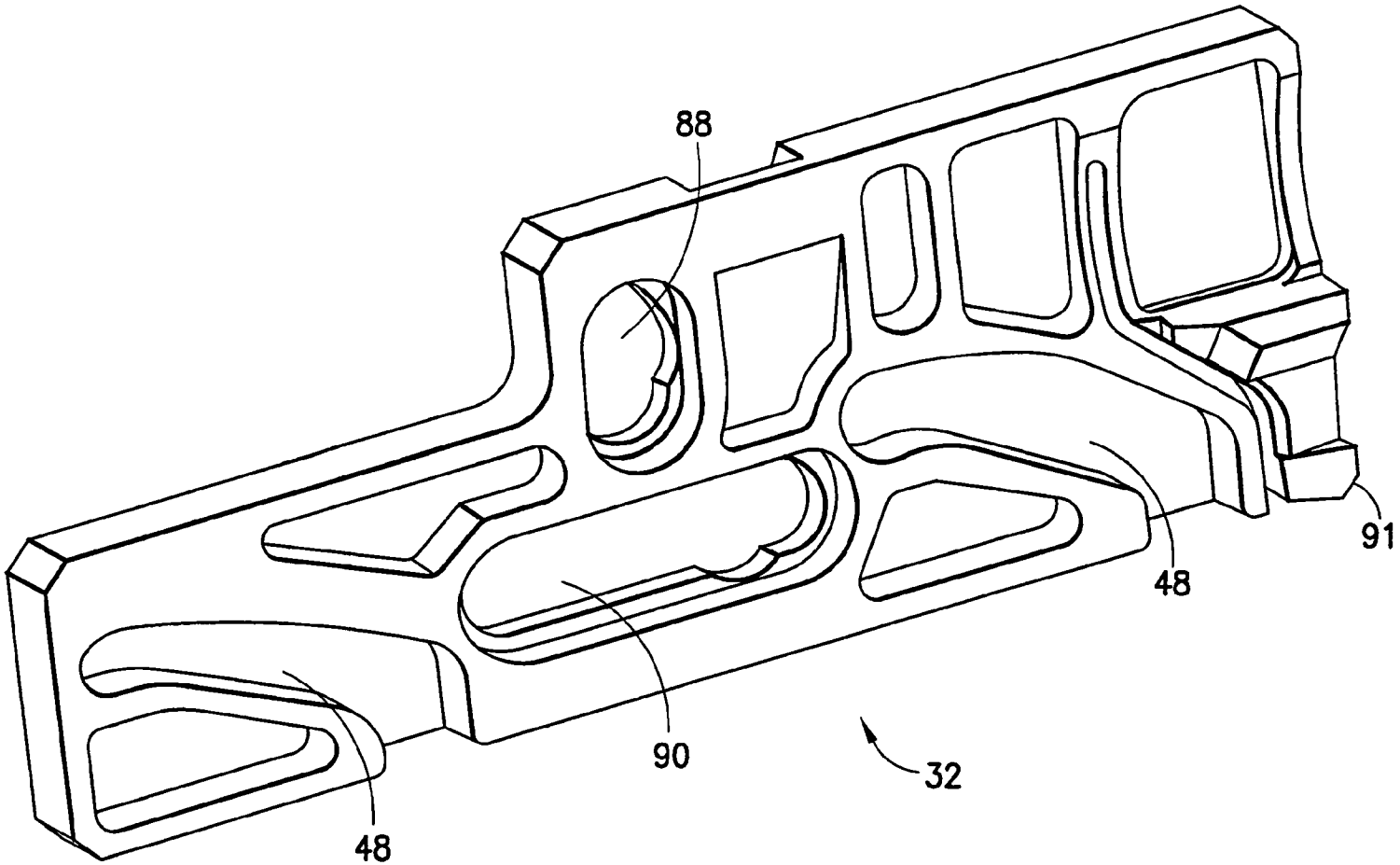
FIG. 11 is a perspective view of one of the cam rod sliders of the electrical connector shown in FIG. 1.
Figure 12:
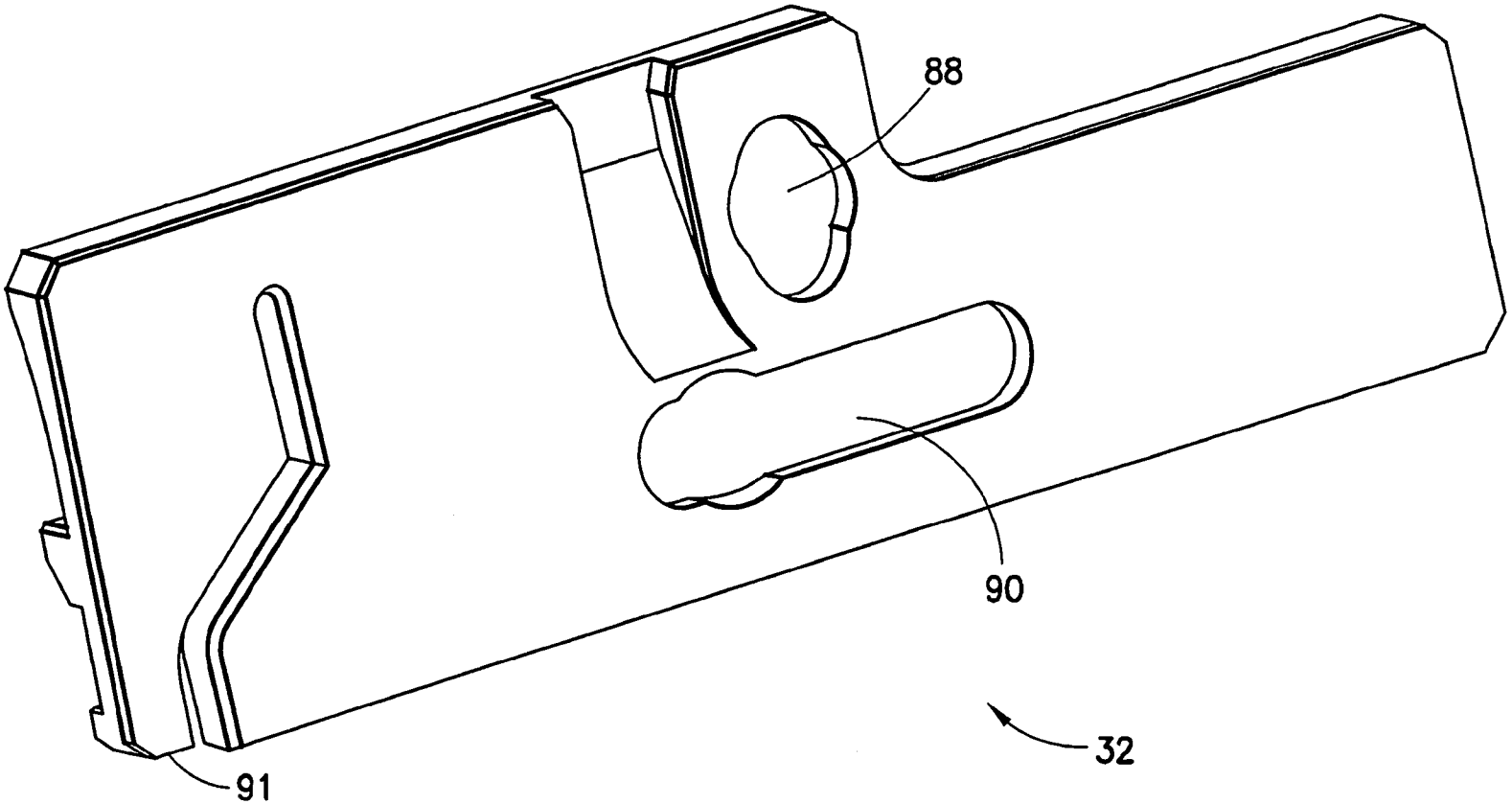
FIG. 12 is a perspective view of the cam rod slider shown in FIG. 11 from an opposite side.

The cam rods or sliders 32 are longitudinally slidably mounted on the first section 28 at two opposite sides of the first section. In particular, the cam rods 32 are longitudinally slidable in the cam rod receiving areas 66. Referring also to FIGS. 10-11, each cam rod 32 preferably comprises a one-piece molded plastic or polymer member. Each cam rod 32 comprises a projection receiving slot 48, a pivot hole 88 and a lever pivot accommodation slot 90. These holes 88 and slots 48, 90 will be further described below. The cam rods 32 also comprise latches 91 for latching the cam rods 32 to the first section 28 at home unlocked positions.

Figure 13:
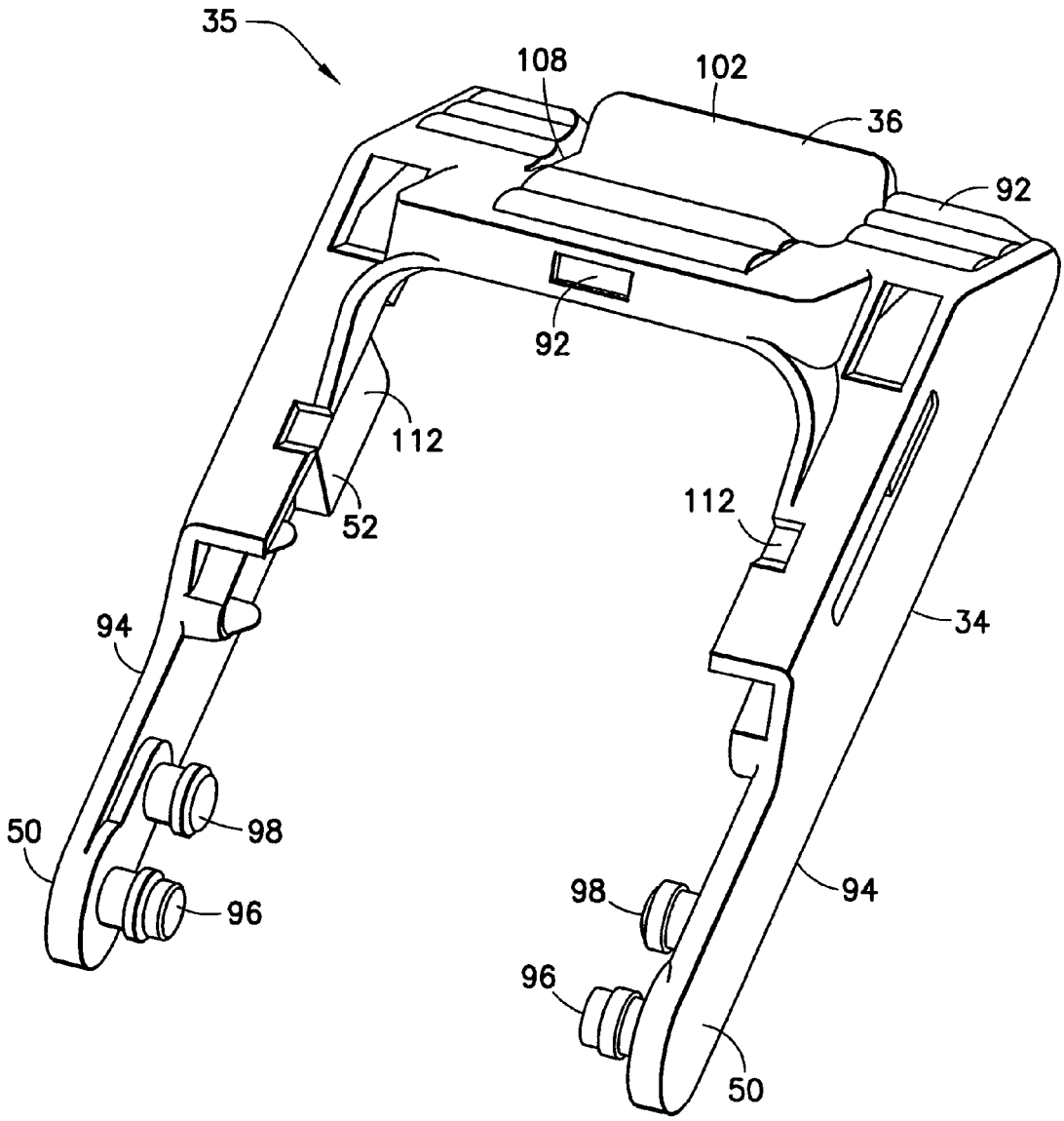
FIG. 13 is a perspective view of the lever assembly of the electrical connector shown in FIG. 1.
Figure 14:
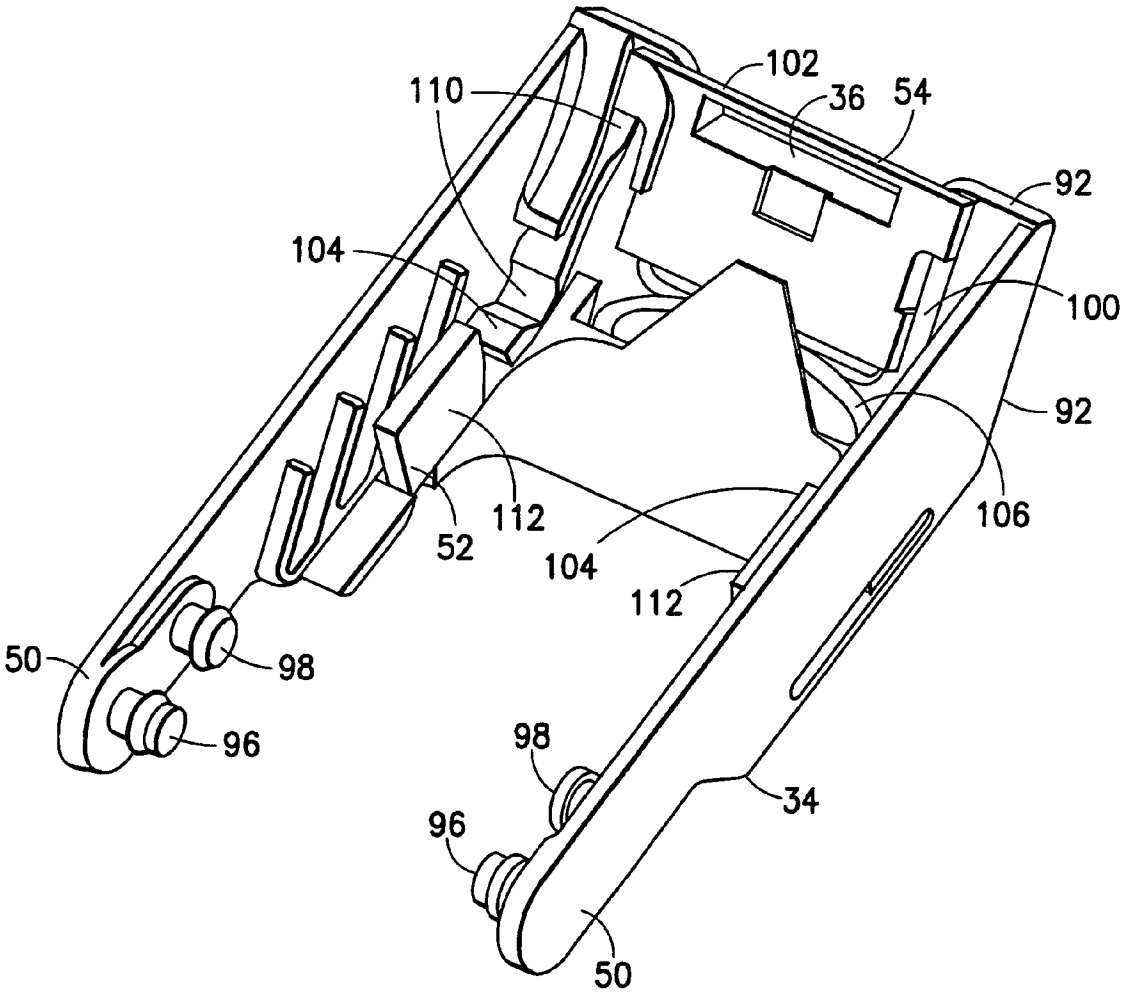
FIG. 14 is a perspective view of the lever assembly shown in FIG. 13 from an opposite side.

Referring also to FIGS. 13-14, perspective views of a combined lever and latch subassembly 35 are shown. The subassembly 35 comprises the lever 34 and the combined latch and CPA lock 36. The combined latch and CPA lock 36 forms a first latch which is movably mounted on the lever 34. The lever 34 is preferably a one-piece molded plastic or polymer member. The lever 34 comprises a head section 92 and two arm sections 94. The end 50 of each arm section 92 comprises two pivot posts 96, 98. The head section 92 has a receiving area 100.

The combined latch and CPA lock 36 generally comprises a head section 102, two arm sections 104 and a spring section 106. The combined latch and CPA lock 36 is preferably a one-piece molded plastic or polymer member. The head section 102 projects out of a top aperture 108 of the head section 92 of the lever 34. The arm sections 104 are slidably received in grooves in the arm sections 94. The arm sections 104 have thin areas 110 which allow the arm sections 104 to be able to bend at the thin areas 110 when the arm sections 104 are slid in the grooves. Ends of the arm sections 104 comprise blocking portions 112. The spring section 106 is located at the rear side of the head section 102. The spring section 106 contacts the rear end of the receiving area 100 in the lever's head section 92. In this embodiment the spring section 106 is a closed loop shaped leaf spring. However, in alternate embodiments any suitable spring could be provided.

Referring back to FIGS. 1-3 and also referring to FIGS. 11-14, the lever 34 is pivotably mounted to the first member 28 at pivot ends 50 on opposite sides of the first section 28. The ends 50 are located at the bottom of the V shaped lever arm receiving area 68 which are at the bottom of the first section 28. This provides an ultra-low lever pivot which yields a high mechanical advantage.

The main pivot posts 96 extend through the longitudinal slots 90 in the cam rods 32 and are pivotably mounted in the pivot holes 76 of the first section 28. The posts 96 are pivotably and slidably located relative to the slots 90. Thus, the cam rods 32 can longitudinally slide as the lever 34 is rotated with the posts 96 staying located in the slots 90.

The slide pivot posts 98 are pivotably connected to the cam rods 32 in the pivot holes 88. The lever 34 is attached to the cam rods 32 to longitudinally move the cam rods 32 along the first section between the unlocked position (shown in FIGS. 1-3) and the locked position (shown in FIG. 21) when the lever 34 is rotated on the first section 28.

Figure 15:
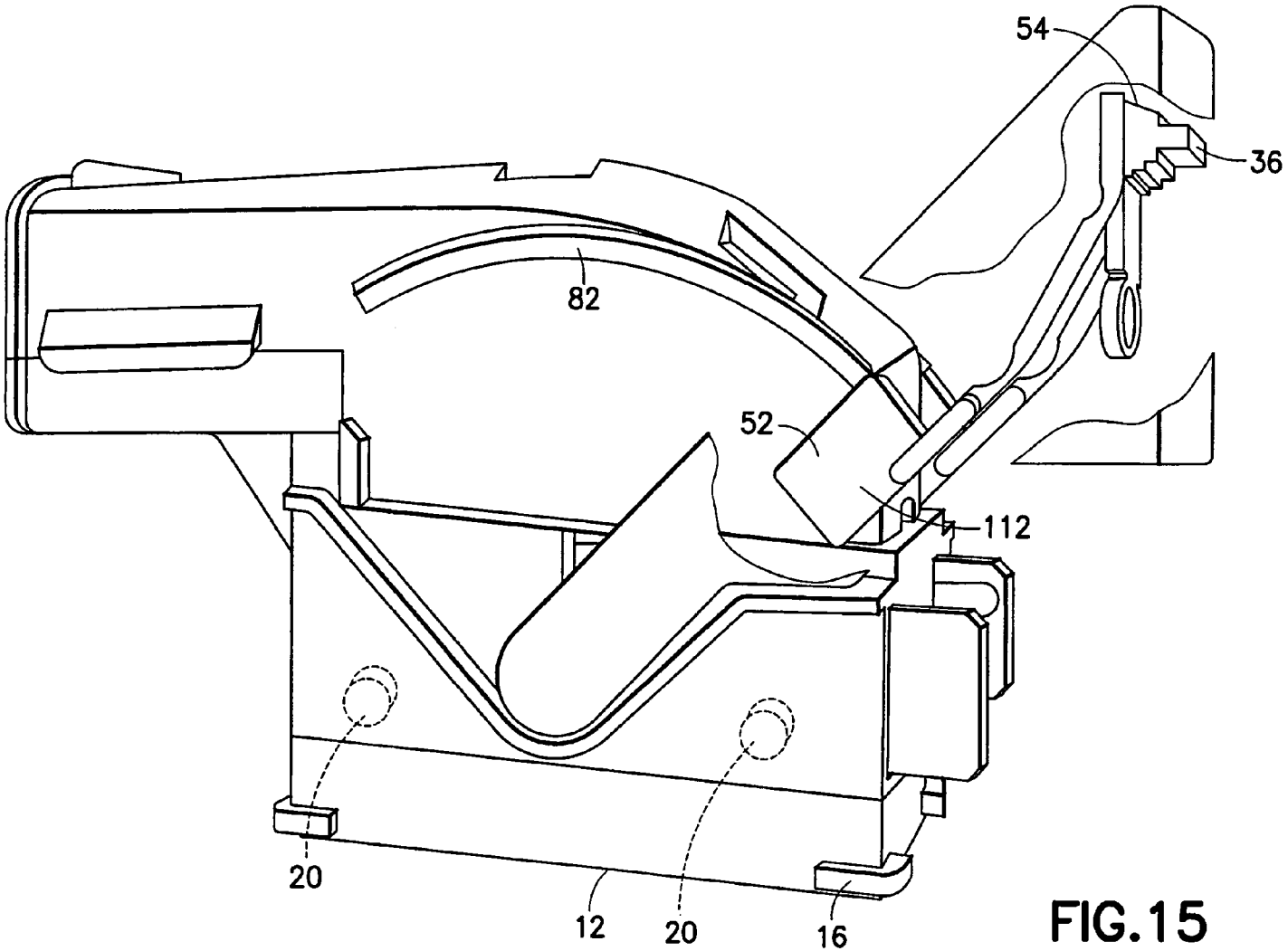
FIG. 15 is a perspective view showing initial connection of the electrical connector shown in FIG. 1 to a mating electrical connector.

As shown in FIG. 15, the lever 34 can be retained in the unlocked position shown in FIGS. 1-3 by the combined latch and CPA lock 36. The combined latch and CPA lock 36 comprises a lever latch portion 52 and a CPA lock portion 54. The lever latch portion 52 comprises the blocking portions 112 which are adapted to be located behind the front ends 136 of the curved projections 82 in the unlocked position shown in FIGS. 1-3 and 15.

Figure 16:
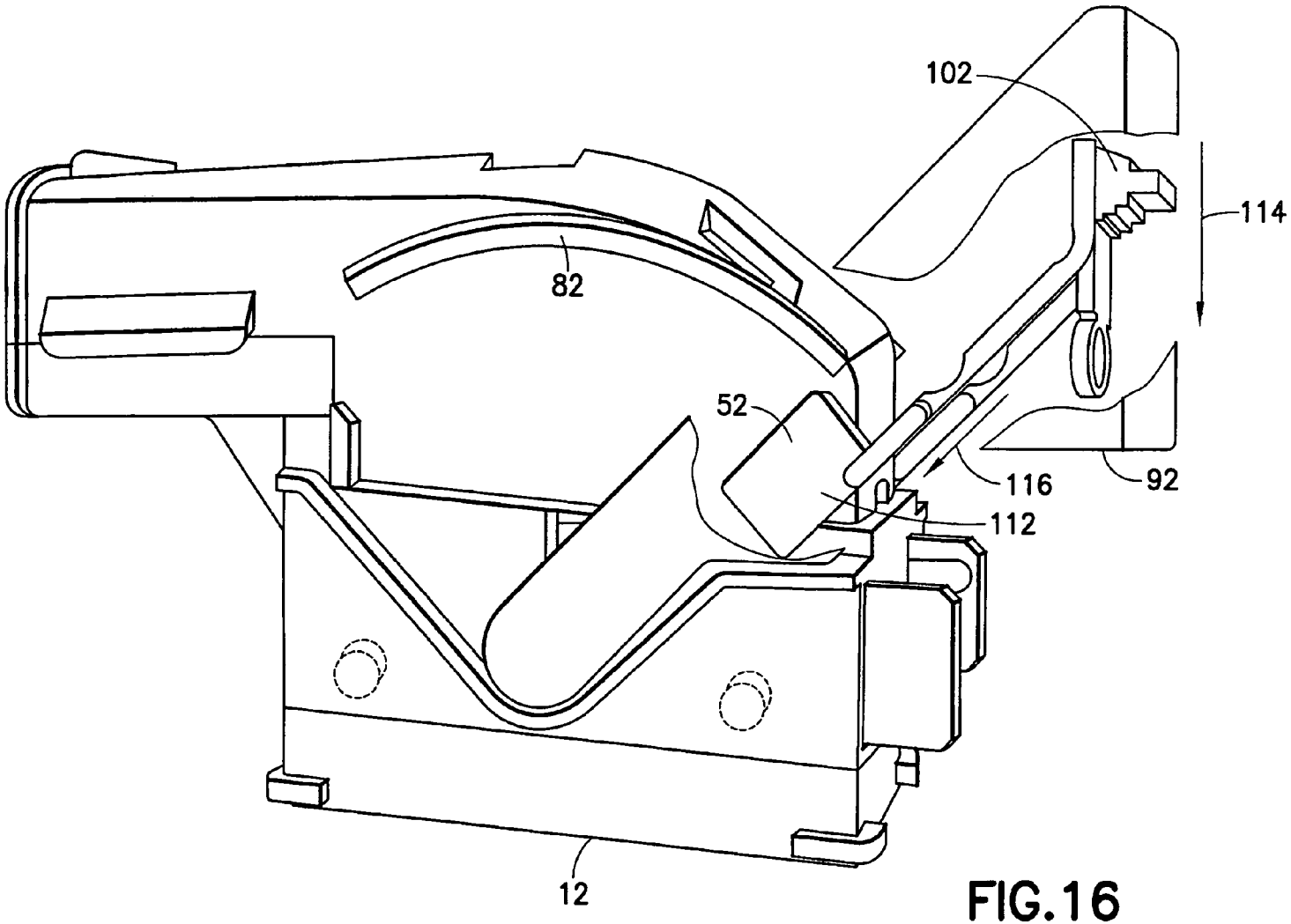
FIG. 16 is a perspective view as in FIG. 15 showing a latch member of the lever assembly moved to an unlatched position.
Figure 17:
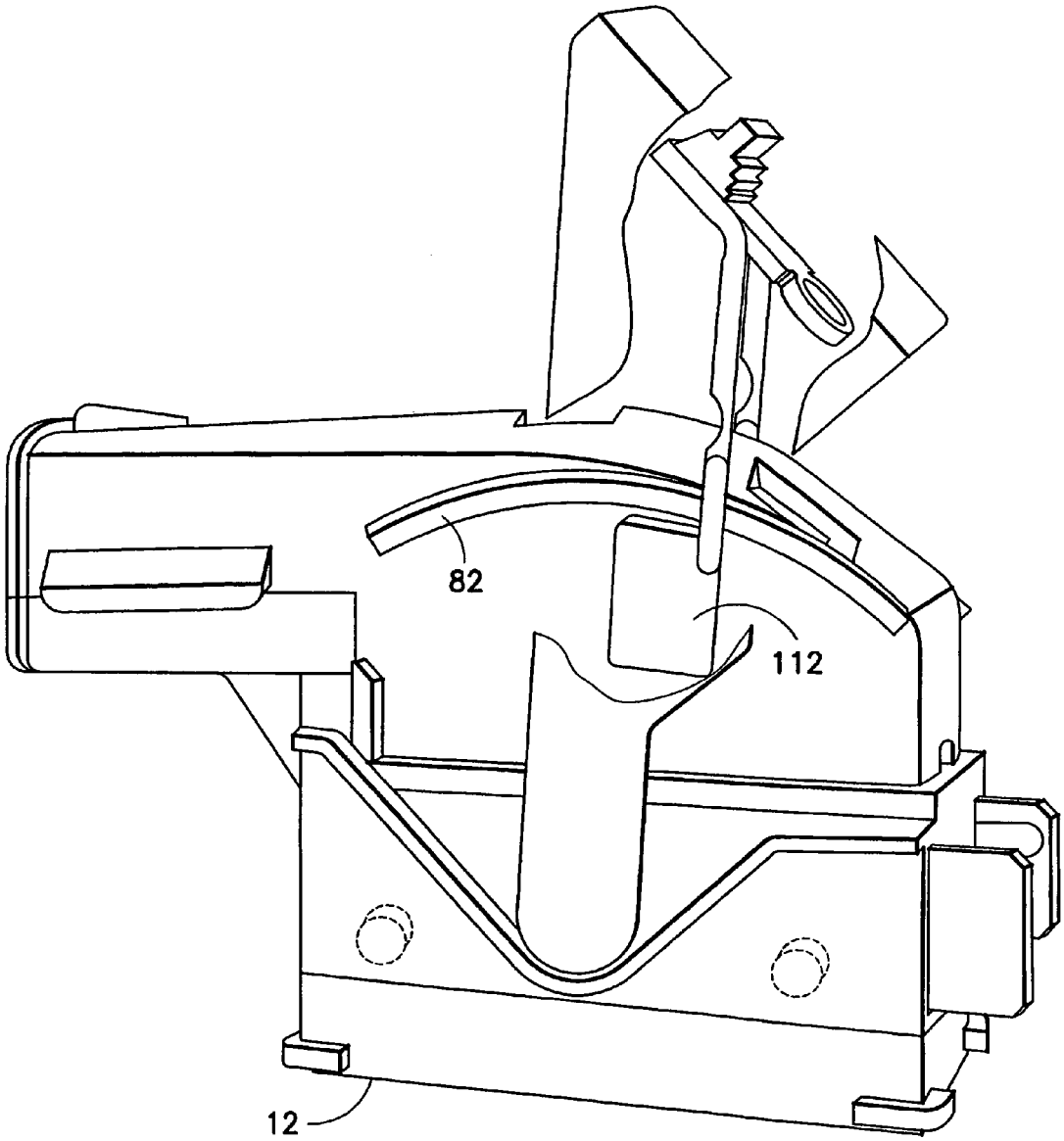
FIG. 17 is a side view of the connectors as shown in FIG. 16 showing the lever assembly partially moved from its forward position towards its rearward position.

Referring also to FIGS. 16-20, in order to move the lever latch portion 52 from its position in front of the curved projections 82, a user can pinch the two head sections 92 and 102 between two fingers. The spring section 106 is able to resiliently deflect or collapse with the head section 102 sliding into the area 100 as shown by arrow 114 and the arm sections 104 sliding towards the ends 50 as shown by arrow 116. This moves the blocking portions 112 underneath the curved projections 82. The arms sections 104 are able to bend at thin areas 110. With the lever latch portion 52 disengaged or unlatched, the user can now rotate the lever 34 rearward as seen in FIG. 17. The blocking portions 112 can move under the curved projections 82.

As seen in FIGS. 15-17, the connector 10 is adapted to mate with a mating electrical connector 12. The mating electrical connector 12 is a conventional electrical connector. The mating electrical connector 12 comprises a housing 16 and electrical contacts. The housing 16 comprises cam projections 20 on its exterior sides.

The projection receiving slots 48 on the cam rods 32 cooperate with the slots 47 in the first section 28 (see FIG. 3) to receive the cam projections 20 of the mating electrical connector 12. More specifically, when the lever 34 is in an unlocked position (FIGS. 1-3), the cam projections 20 can be inserted into the bottoms of the slots 47, 48. In this embodiment, the connector 10 includes a mating electrical connector initial connection retainer system. However, in an alternate embodiment a mating electrical connector initial connection retainer system might not be provided. The retainer system comprises the main housing member 28 having the entry slot 47 for receiving the cam pin 20, wherein the cam slot 48 and the entry slot 47 are initially partially offset to form a restricted cam pin path. Before actuation of the mate assist system, when the electrical connector 10 is initially mounted on the mating electrical connector 12, the retainer system is adapted to frictionally trap the cam pin 20 of the mating electrical connector 12 between portions of the entry slot 47 and the cam slot 48 to initially retain the electrical connector 10 on the mating electrical connector 12 until the mate assist system is actuated by a user.

The connector 10 provides a system for preventing unintentional movement of the lever 34 from its unlocked position shown in FIGS. 1 and 2. The system for preventing unintentional movement of the lever comprises a first latch adapted to be manually actuated by a user and a second latch on the cam rods 32 adapted to be automatically moved by the mating electrical connector 12 when the connector 10 is initially mounted on the mating electrical connector. The second latch uses the latches 91 on the cam rods 32. As the mating connector 12 is initially inserted into the first section 28, the housing 16 moves the latches 91 of the cam rods 32 out of latching engagement with the first section 28. The first latch comprises the member 36 and its engagement with the projection 82. Both the first and second latches are moved to enable movement of the lever 34 from the forward unlocked position. Thus, a redundant active/passive pre-lock lever release system is provided. The active release system is on the lever latch 36 and involves the blocking sections 112. The passive release system is on the cam rods 32 and involves the latches 91.

As the cam rods 32 are slid by the lever 34 from their forward positions to their rearward positions (see FIGS. 16-18), the cam rods 32 can cam the cam projections 20 further into the slots 47, 48 to pull the two connectors 10, 12 together. Thus, this assists in mating the connectors 10, 12 together.

Figure 18:
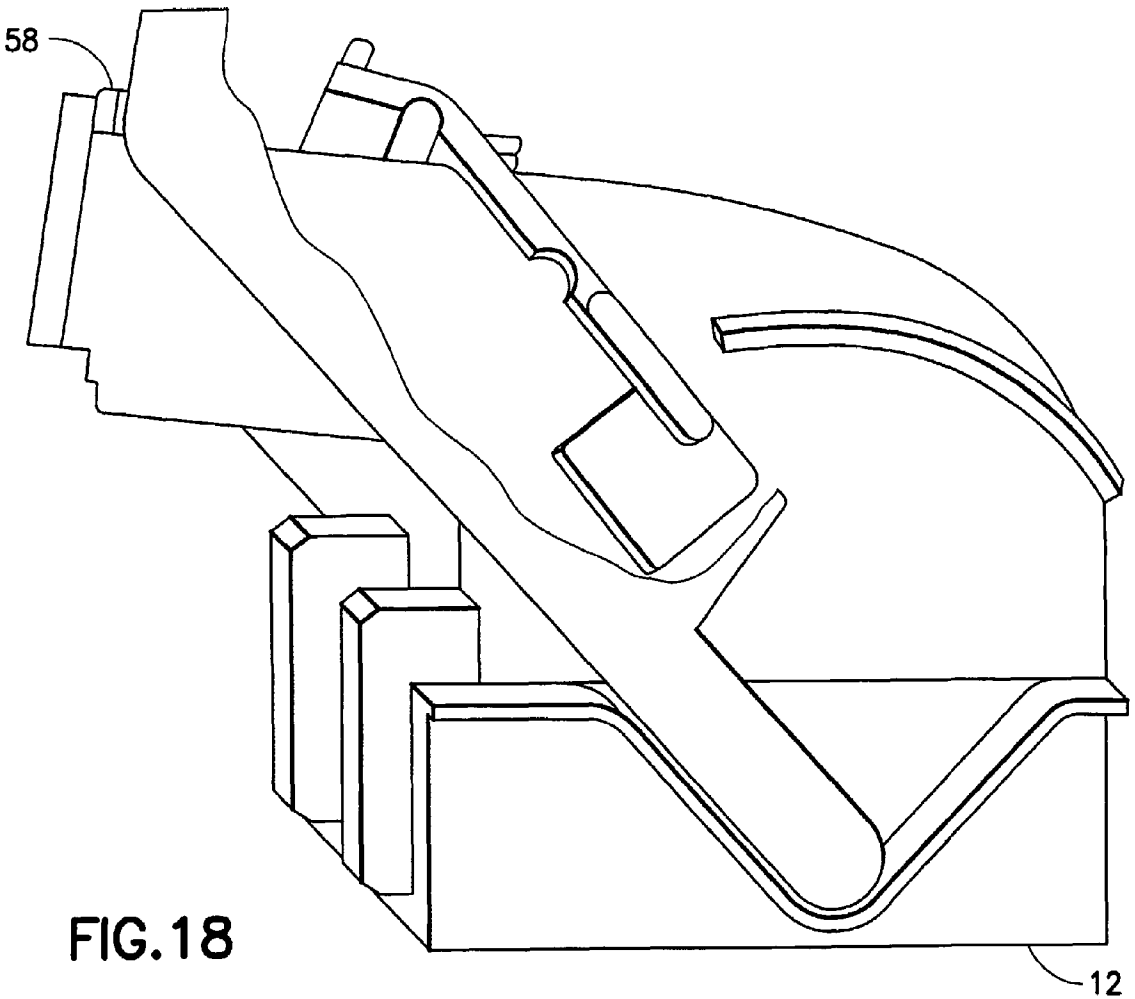
FIG. 18 is a side view of the connectors as shown in FIG. 17 showing the lever assembly partially moved from its rearward position, but before release of the latch member.
Figure 19:
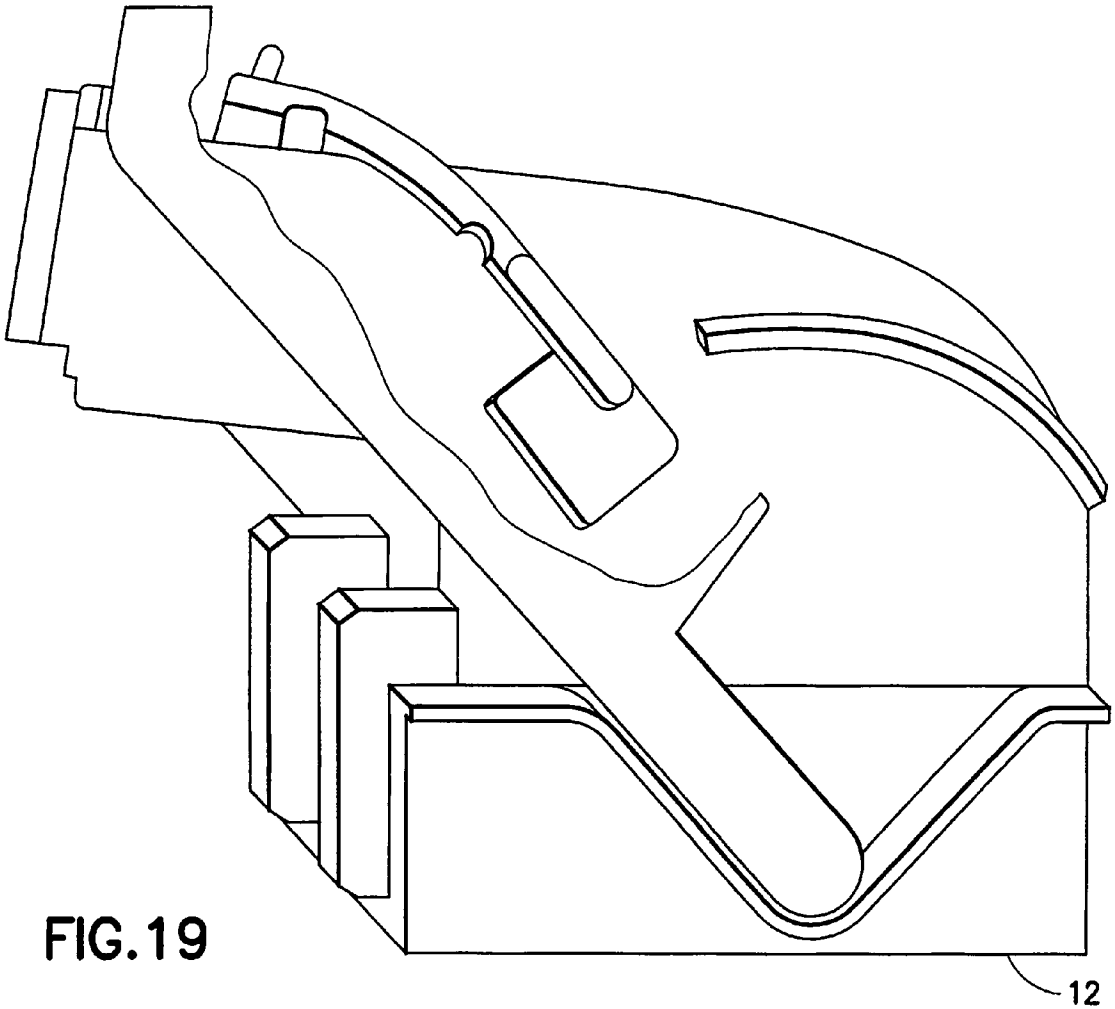
FIG. 19 is a side view of the connectors as shown in FIG. 18 showing the lever assembly partially moved from its rearward position, and partial release of the latch member.
Figure 20:
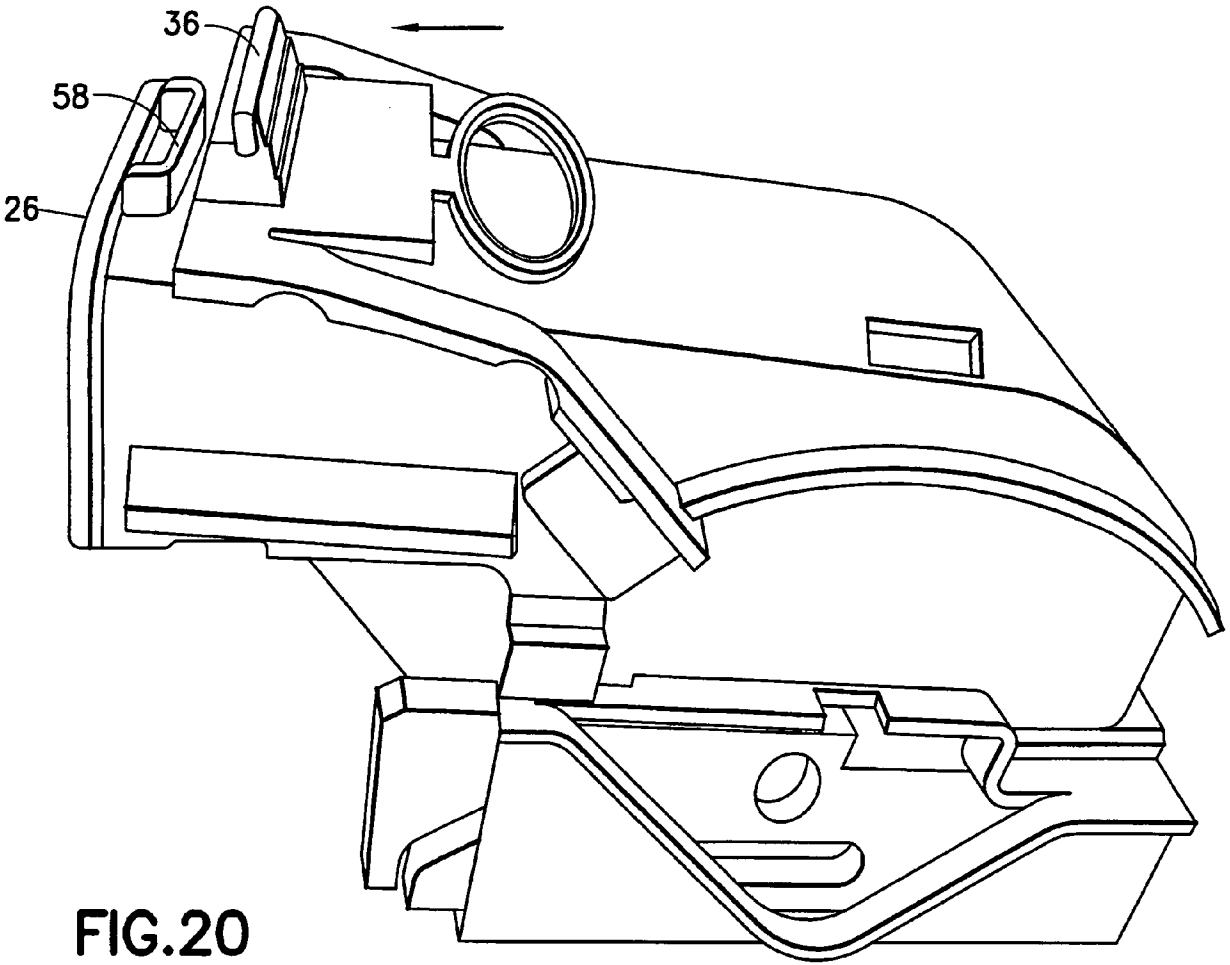
FIG. 20 is top and side perspective view of the connectors as shown in FIG. 19 showing the lever assembly partially moved from its rearward position, and release of the latch member, but before latching of the latch member to a latch on the housing.

When the lever 34 reaches its rearward position on the first section 28, the blocking sections 112 are located past the rear ends 138 of the curved projections 82 as seen in FIG. 18. The user can release the head section 102, and the spring section 106 can then deflect the combined latch and CPA lock 36 back to its home position in the lever 34. The blocking sections 112 project behind the curved projections 82 to prevent the lever 34 from being inadvertently rotated back towards the front of the connector 10.

Figure 21:
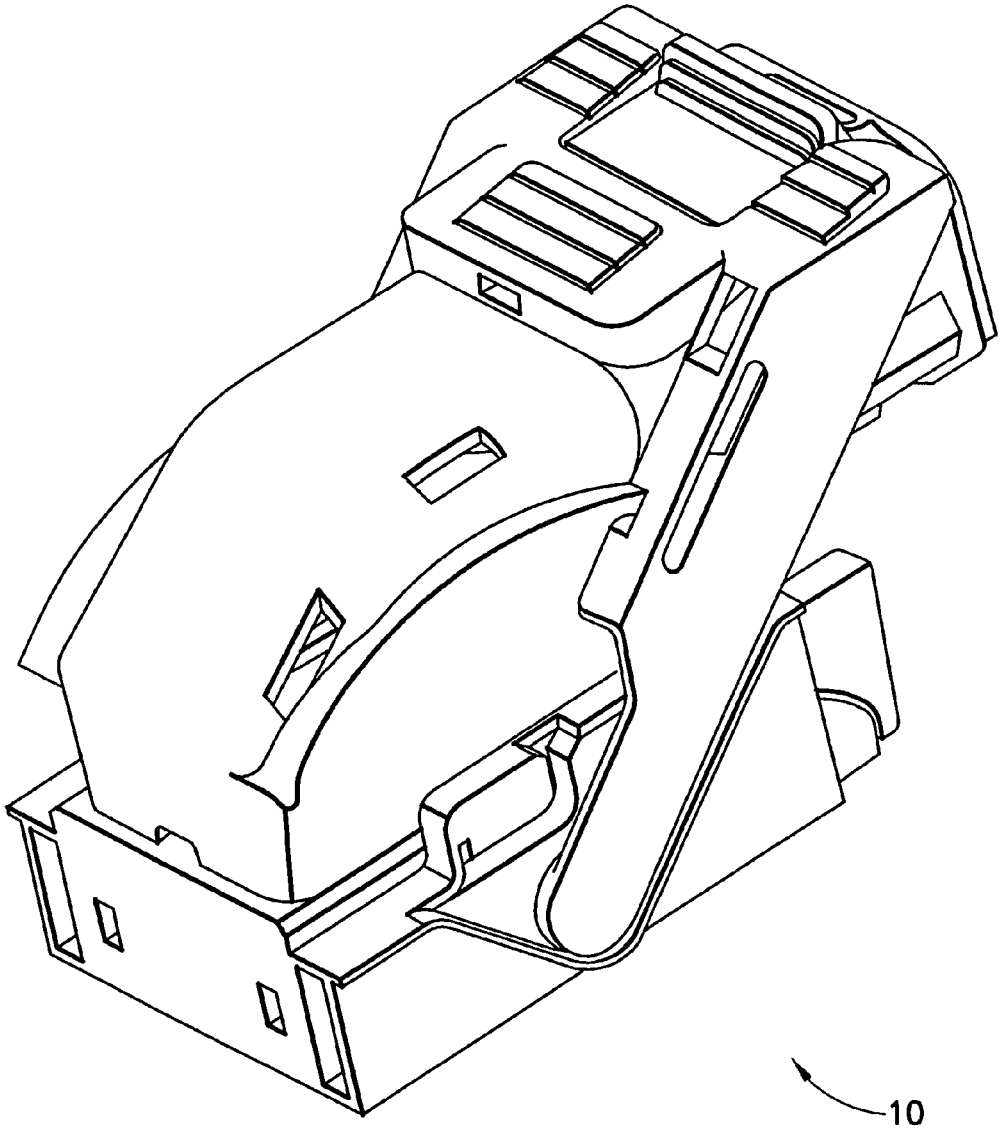
FIG. 21 is a perspective view of the electrical connector of the invention as shown in FIG. 20 with the latch member of the lever assembly moved to its latching position with the housing.

The cover 30 comprises a CPA latch 58 at its rear end 26. The head section 102 of the combined latch and CPA lock 36 can engage the latch 58 to prevent the combined latch and CPA lock 36 from inadvertently moving relative to the lever 34. Preferably the engagement of the combined latch and CPA lock 36 with the CPA latch 58 is a manual locking action by a user. The latching by the blocking section 112, on the other hand, is preferably an automatic latching as the user releases the pinching action or moves the blocking sections 112 past the end 138 of the projections 82. FIG. 21 shows the connector 10 at its final locked position. The blocking portions 112 are sufficiently long such that movement of the CPA lock portion 54 into engagement with the CPA latch does not move the blocking section 112 out of the path of the curved projection 82.

The lever release and rotation from the unlocked position (FIGS. 1-3) to the locked position (FIG. 21) can be done by a single hand of a user. The lever latch can be released after initial movement from the unlocked position because the blocking sections 112 are located under the curved projections 82 and can ride or slide along the bottom surfaces of the projections 82. Once the combined latch and CPA lock 36 is at the position shown in FIGS. 19-20, the user can lock the CPA by dragging his finger off the lever, moving the CPA into the latch 58, at the end of the lever rotation.

Figure 22:
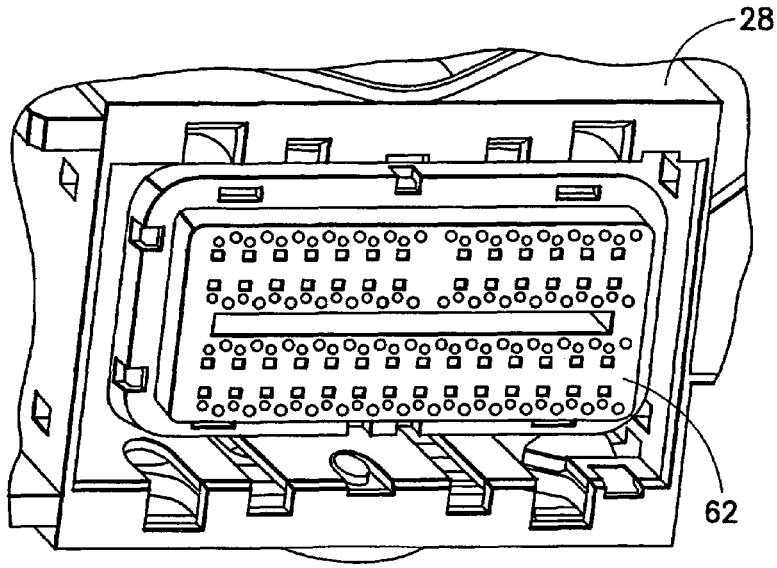
FIG. 22 is a bottom, rear and side perspective view of the electrical connector shown in FIG. 1 showing the TPA member in an unlocked position on the main housing member.
Figure 23:
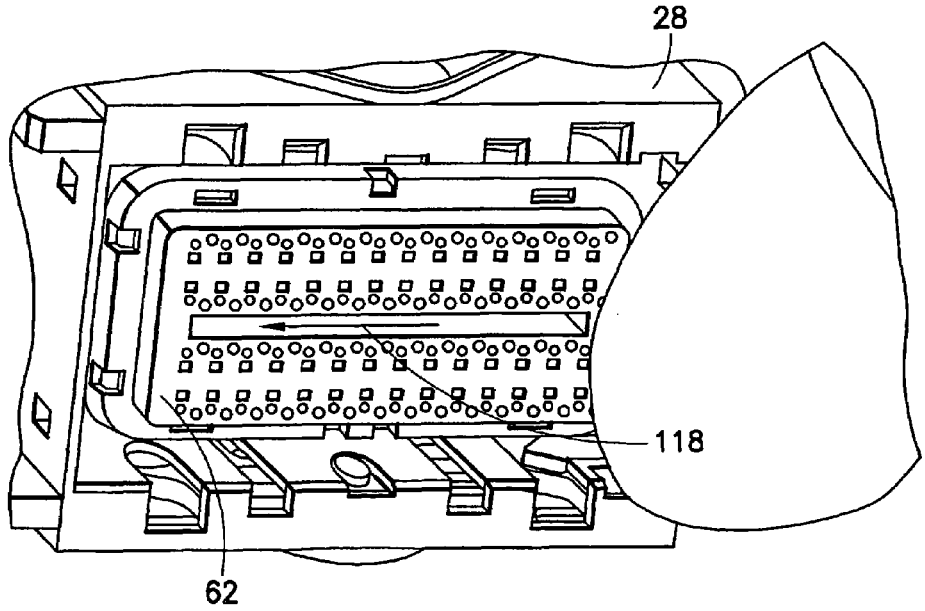
FIG. 23 is a perspective view as in FIG. 22 showing the TPA member moved to a locked position on the main housing member.
Figure 25:
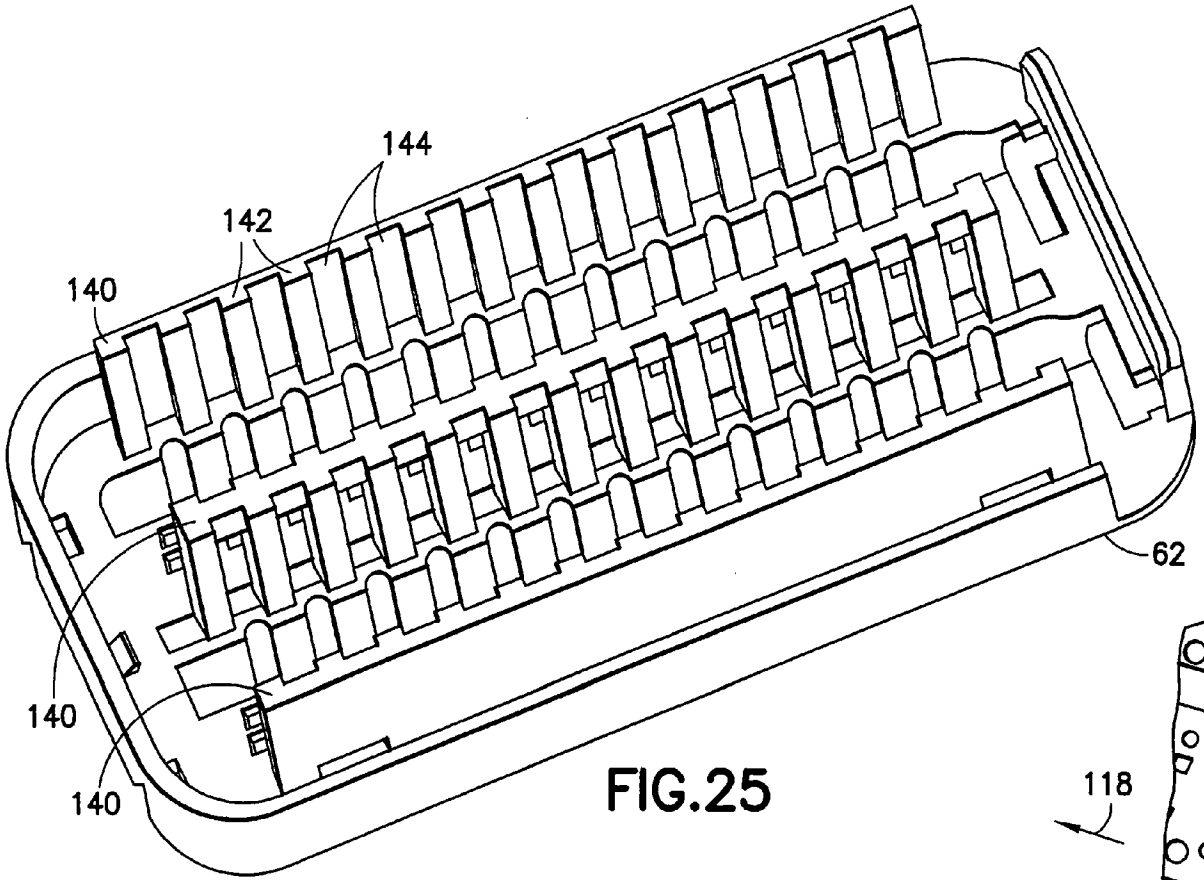
FIG. 25 is a top, rear and side perspective view of the TPA member of the electrical connector shown in FIG. 1.

As shown in FIGS. 3-4 the connector 10 comprises a TPA member 62. However, in alternate embodiments the TPA member 62 might not be provided. Because of the shape of the first section 28 of the housing 22 surrounding the contact receiving areas 64 and lock fingers 130 (see FIGS. 5A and 3), the TPA member 62 is initially inserted into the housing shown in FIGS. 5B and 22 by inserting the TPA member into the bottom side of the housing. Referring also to FIGS. 22-23, the TPA member can be slid from the home unlocked position shown in FIGS. 5B and 22 to the locked position shown in FIG. 23 by sliding the TPA member from front to rear (as shown by arrow 118) by a user. Thus, unlike conventional TPA members, the movement of the TPA member 62 is not between an inward position and an outward position. Instead, the movement of the TPA member 62 is from front to rear; orthogonal to the direction of initial connection of the TPA member to the housing and orthogonal to the direction of connection of the connector 10 to the mating connector 12. This is also orthogonal to the direction of insertion of the contacts 24 into the housing member 28. Thus. the direction of movement of the TPA member from the home unlocked position to the locked position is generally orthogonal to a direction of initial insertion of the TPA member into the housing. The TPA can assure the position of the contacts 24 in the first section 28 at their intended final position. As seen in FIGS. 5B and 25, the TPA member has cantilevered blocking projections 140. The projections 140 comprise thicker rail sections 142 and slots 144 between the thicker rail sections 142. When the contacts 24 are initially inserted into the contact receiving areas 64, the TPA member 62 is at its unlocked position. The slots 144 are aligned with the lock fingers 130 to allow the lock fingers to deflect backward as the contacts are inserted.

After the contacts are inserted into the receiving areas, the TPA member 62 is slid to its locked position to move the thicker rail sections 142 behind each of the lock fingers 130. When moved to its locked position, the TPA member 62, thus, blocks the lock fingers 130 from deflecting backwards and prevents the contacts 24 from being pulled or pushed out of the receiving areas 64. In addition, the TPA member signals to the user if one or more of the contacts 24 are only partially installed. If a contact is partially installed, its corresponding lock finger would still be deflected backwards. Thus, when the user tries to move the TPA member 62 to its locked position, the deflected lock finger will block the TPA member 62 from moving because it is still in one of the slots 144 and does not allow the corresponding thicker rail section 142 to move behind the deflected lock finger. The user then knows that at least one contact is not properly seated in its receiving area. In alternate embodiments any suitable TPA system could be provided. Alternatively a TPA system might not be provided.

Figure 26:
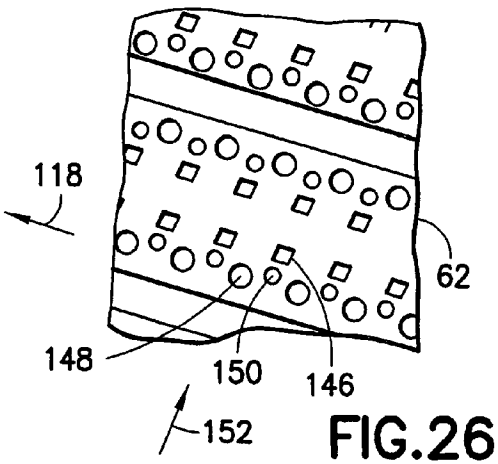
FIG. 26 is a partial, enlarged perspective view of a bottom side of the TPA member shown in FIG. 25.

Referring also to FIG. 26, in the embodiment shown the TPA member 62 has male pin entry holes 146, terminal service/removal holes 148 and pogo pin testing access holes 150. For each contact receiving area the TPA member comprises the male pin entry hole 146, the test probe entry hole 150, and the terminal service hole 148. For each contact receiving area 64 the respective male pin entry hole 146 and the test probe entry hole 150 are aligned in a first direction 152 on the TPA member. This is a lateral direction in this embodiment. The respective terminal service hole 148 is at least partially offset from the male pin entry hole 146 and the test probe entry hole 150 in the second direction 118 angled to the first direction. The male pin entry hole 146 allows insertion of the male contact from the mating electrical connector 12 into the connector 10 and its intended contact 24. The test probe entry hole 150 allows electrical testing of the contact 24 and its connection to its wire by allowing insertion of a test probe into the contact receiving area 64 and into contact with the electrical contact 24. The terminal service hole 148 allows insertion of a tool into the contact receiving area 64 to disengage the lock finger 130 from the contact 24 and allow removal of the contact 24 from the contact receiving area 64 for servicing or replacement.

In this embodiment, the offset of the terminal service hole 148 was discovered to be needed because of the need for the TPA member to be in its open or unlocked position to remove a contact. The hole 148 is not aligned with its corresponding lock finger 130 when the TPA member is in its locked position. Thus, the offset of the hole 148 provides alignment of the hole 148 with its corresponding lock finger 130 when the TPA member 62 is in its open position. However, in alternate embodiments any suitable hole pattern or shape of holes could be provided.

Referring also to FIGS. 27-33 an alternate embodiment of the invention is shown. In this embodiment the electrical connector 160 generally comprises a housing 162, electrical contacts 24, and a mate assist system 164. The housing 162 comprises the main section 28 and a wire dress cover 172. The wire dress cover 172 has two curved projections 82 on its opposite exterior lateral sides. The cover 172 also has a deflectable latch 174 on its top side.

The mate assist system 164 comprises a lever assembly 166 and the cam rods or sliders 32. The lever assembly 166 has a first member 168 and a second member 170. The first member 168 is a pivot lever member which is pivotably connected to the housing 162. The second member 170 is a telescoping member telescopically connected to the first member 168. The lever assembly 166 and the wire dress cover 172 cooperate to form a first latch for limiting movement of the sliders 32.

Figure 28:
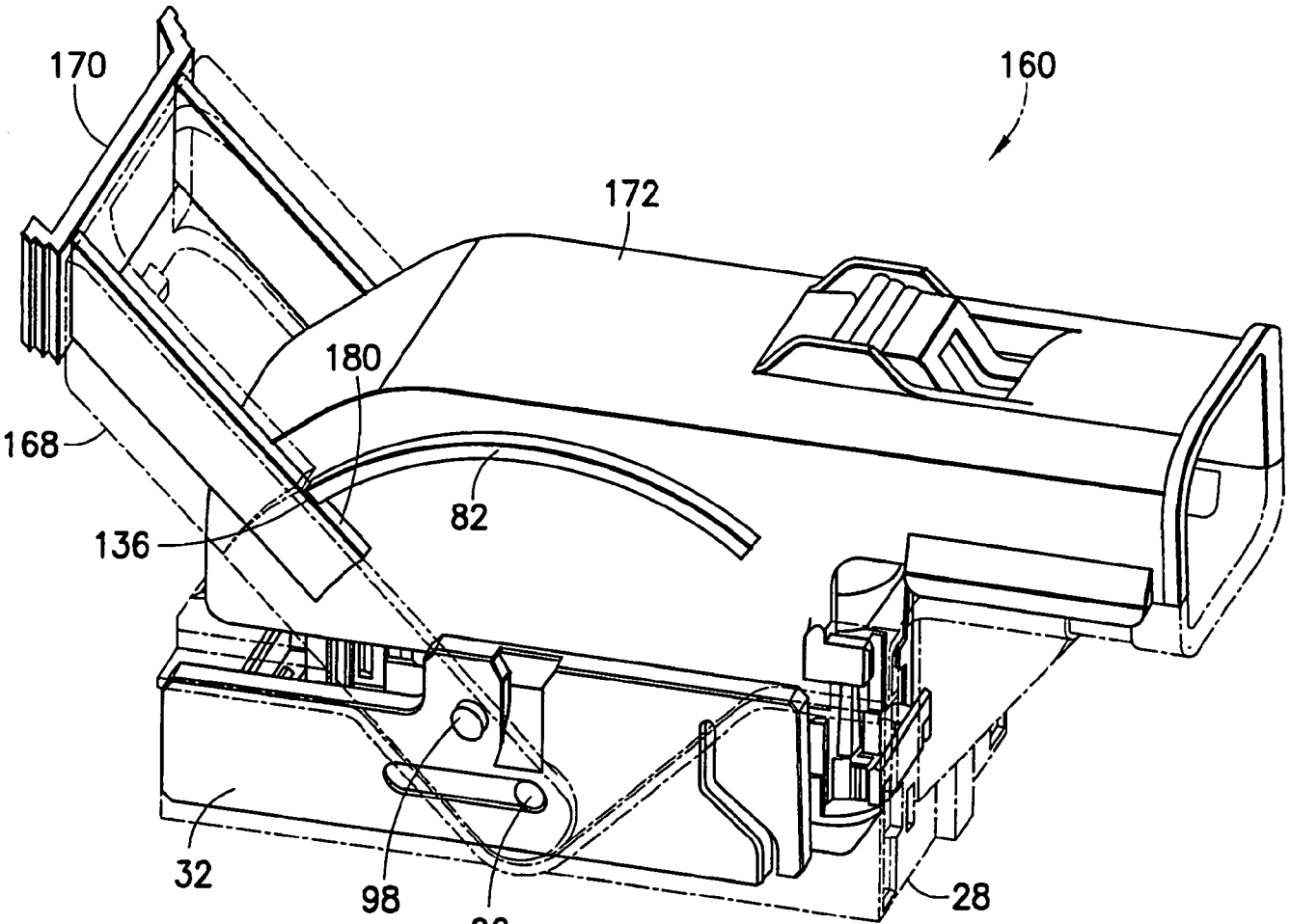
FIG. 28 is a perspective view of the electrical connector shown in FIG. 27 with some of the components shown in phantom.

The first member 168 has two arms 176 connected to each other by a top bridging section 178 to form a general upside-down U shape. As seen in FIG. 28, ends of each arm have two pivot posts 96, 98. The pivot posts 96, 98 are attached to the cam rods 32 and the housing member 28 in the same manner as described above with reference to the first embodiment. The second member 170 has two arms 180 and a top bridging section 182. The arms 180 extend through slots in the bridging section 178 and are slidably located in pockets along the insides of the arms 176.

Figure 27:
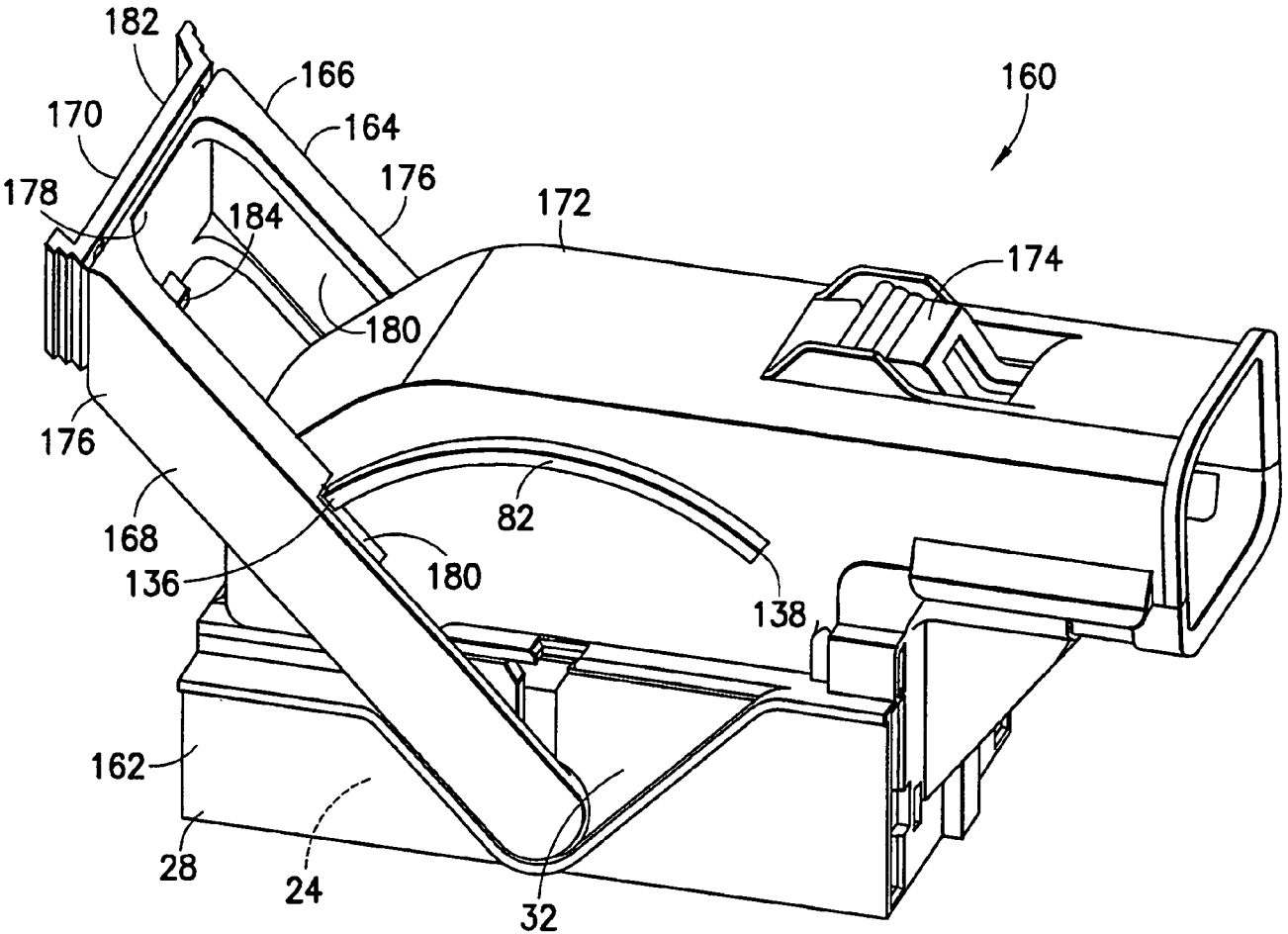
FIG. 27 is a perspective view of an alternate embodiment of the electrical connector.

FIGS. 27 and 28 show the lever assembly 166 in its forward pre-lock position on the housing. In this position, portions of the arms 180 are located at the front ends 136 of the projections 82. Thus, the lever assembly 166 is prevented from rotating on the housing from this position. This prevents the cam rods 32 from longitudinally sliding in the housing member 28.

Figure 29:
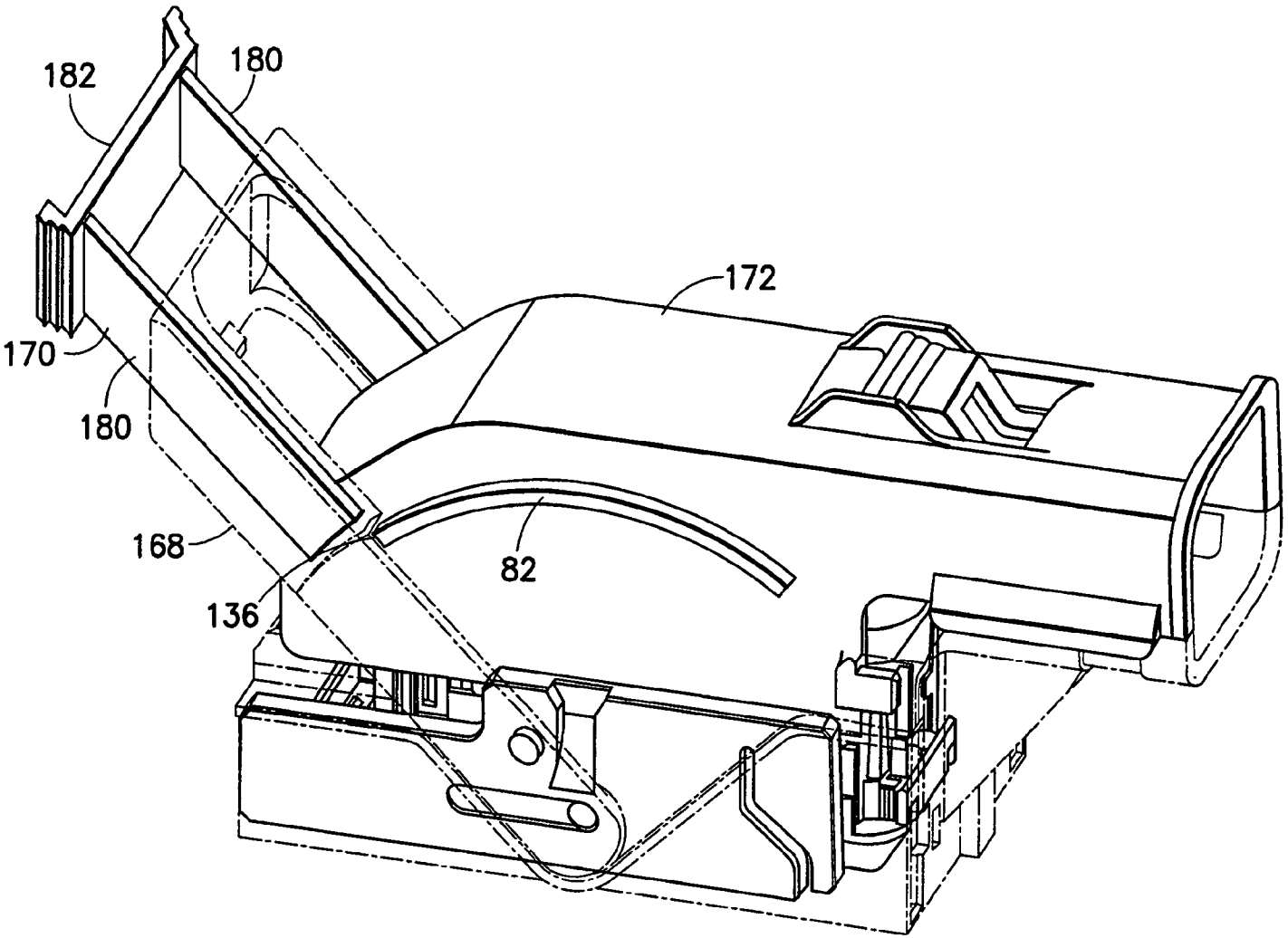
FIG. 29 is a perspective view as in FIG. 28 showing the second member of the lever assembly moved to an extended position.
Figure 30:
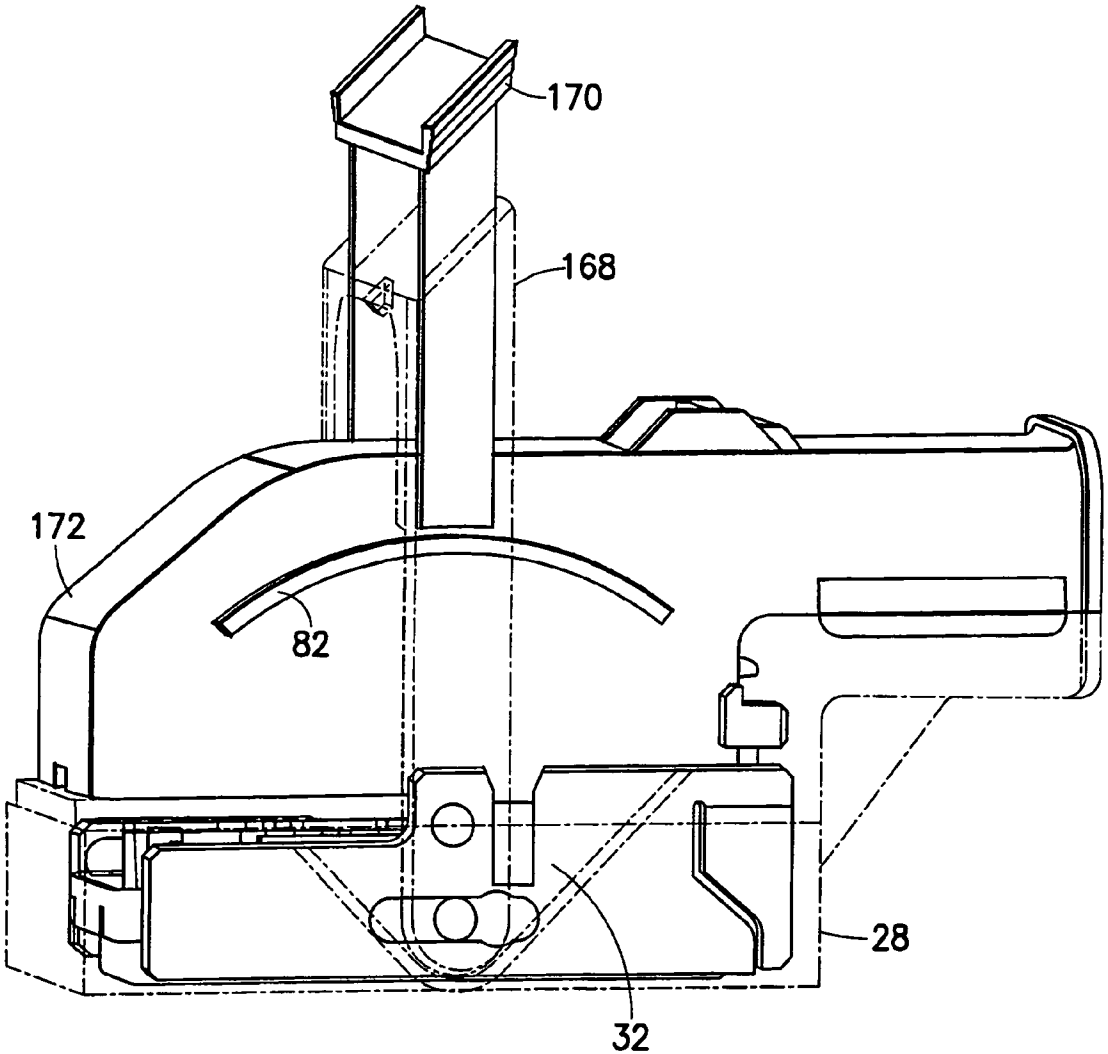
FIG. 30 is a perspective view as in FIG. 29 showing the lever assembly partially moved from its forward position towards its rearward position.

As seen in FIGS. 29 and 30, a user can extend the second member 170 relative to the first member 168 in a general telescoping fashion. This moves the arms 180 from in front of the front ends 136 of the projections 82, and allows the user to rotate the lever assembly 166 on the housing. The cam rods or sliders 32 are, thus, moved.

Figure 31:
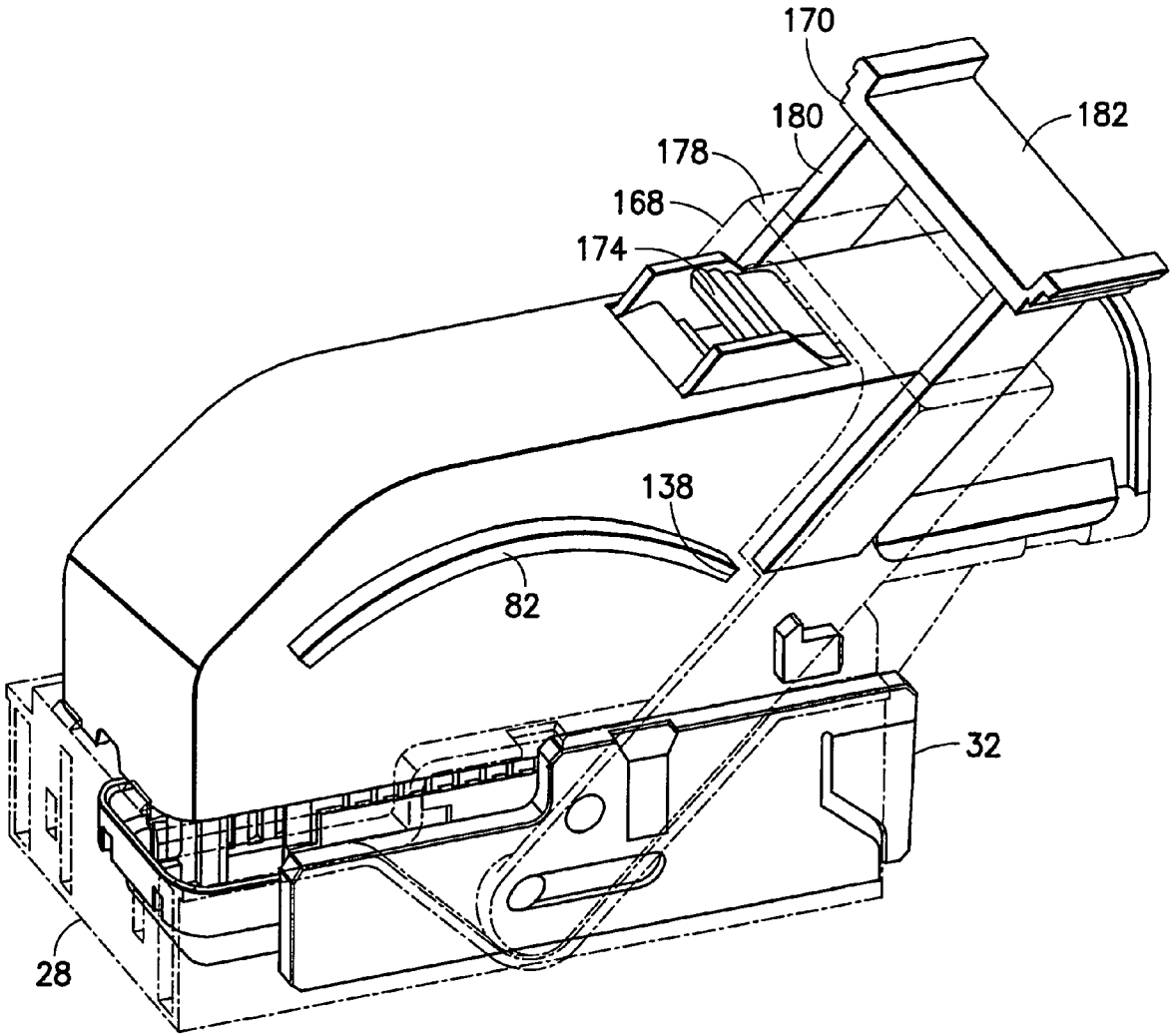
FIG. 31 is a perspective view as in FIG. 30 showing the lever assembly moved to its rearward position, but before collapsing of the lever assembly.
Figure 32:
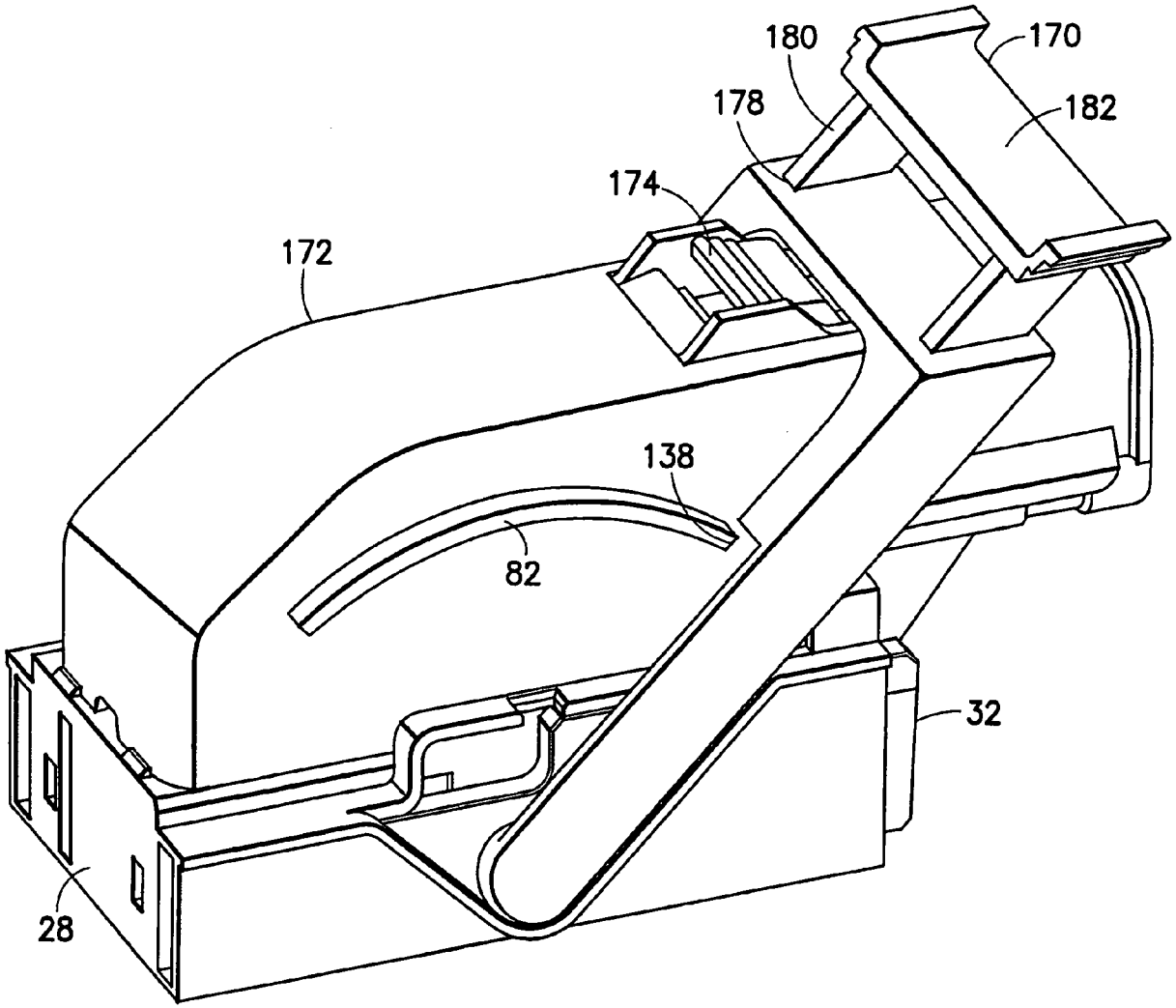
FIG. 32 is a perspective view as in FIG. 31 without components shown in phantom.
Figure 33:
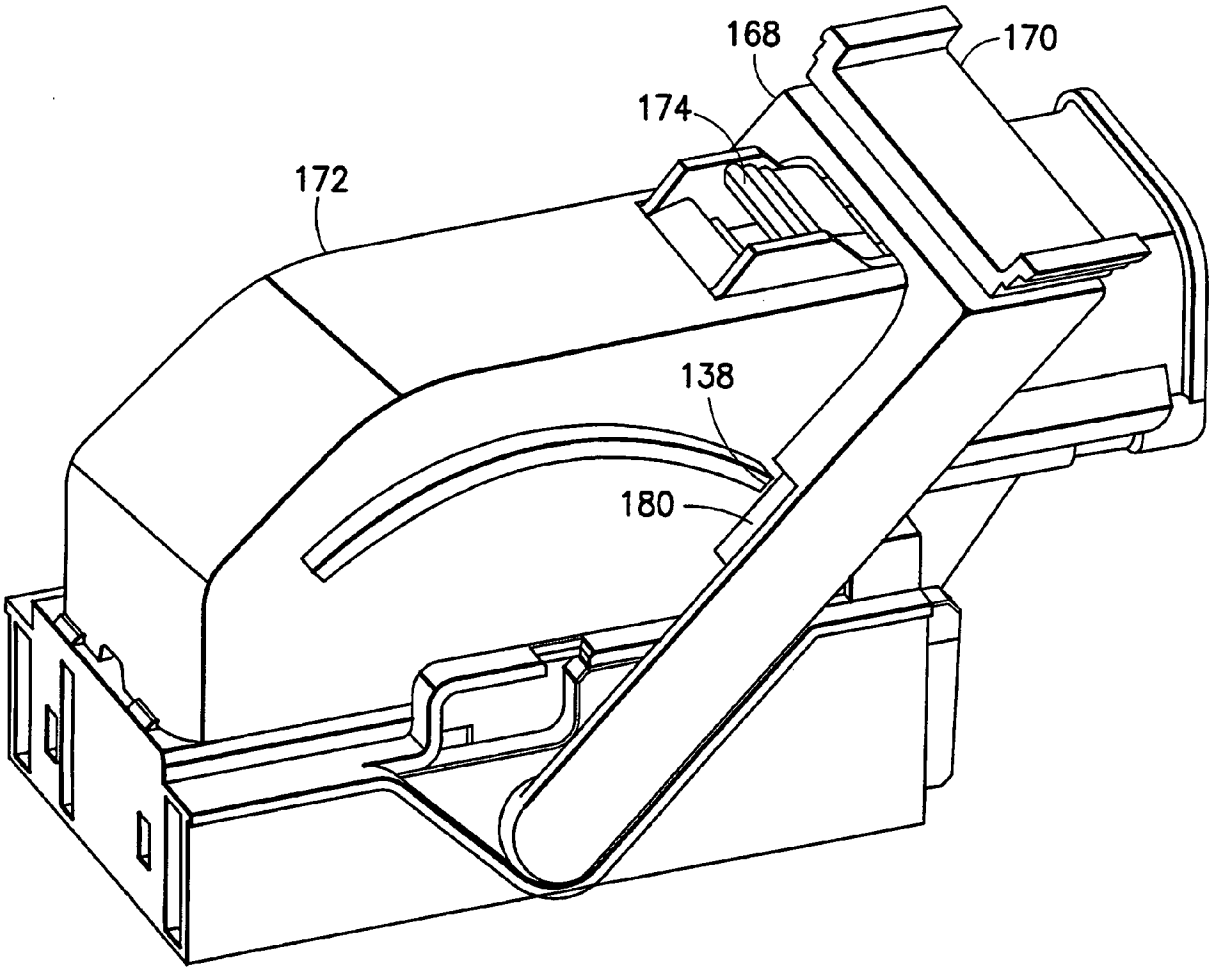
FIG. 33 is a perspective view as in FIG. 32 showing the lever assembly at its rearward position with the lever assembly in its collapsed position.

As seen in FIGS. 31-33, when the lever assembly 166 reaches its rearward final lock position on the housing, the cam rods have been moved to their final connection positions. The first member 168 has a latch projection 184 which latches with the deflectable latch 174. This locks the first member 168 at its rearward position. The user can collapse the second member 170 back into the first member 168. Portions of the arms 180 are moved behind the rear ends 138 of the projections 82. Thus, the lever assembly 166 engages the cover 172 at multiple locations (including the projections 82 and the latch 174) to prevent inadvertent, unintentional movement of the lever assembly and the mate assist system.

One of the features of this second embodiment is the increased mechanical advantage or leverage that is provided. In particular, because the length of the lever assembly 166 is lengthened during movement of the sliders 32, there is a greater mechanical advantage provided by the lever assembly than if the lever assembly was not lengthened. Collapsing of the lever assembly also provides the advantage that the final assembly has packaging in relatively the same space constraint. Also, the second lever can be modified to act as a CPA. However, in this embodiment the function is not required. In alternate embodiments, other types of telescoping and collapsing lever assemblies could be provided. It could also be used with other types of cam rod and housing designs.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

a housing comprising contact receiving areas and contact latches;

electrical contacts located in the receiving areas and retained with the housing by the latches; and a terminal position assurance (TPA) member movably connected to the housing, wherein the TPA member is slidably connected to the housing between an unlocked position and a locked position, wherein in the unlocked position the TPA member allows the latches to move to a disengaged position with the contacts, and wherein in the locked position the TPA member prevents the latches from deflecting to the disengaged position, and wherein the TPA member is slidable on the housing between the unlocked position and the locked position in a first direction which is orthogonal to a second direction of insertion of the contacts into the housing, and wherein the first direction is generally orthogonal to a direction of initial insertion of the TPA member into the housing.

2. An electrical connector as in claim 1 wherein the first direction is orthogonal to a direction of connection of the electrical connector to a mating electrical connector.

3. An electrical connector as in claim 1 wherein the latches are resiliently deflectable cantilevered latches integrally formed with the housing.

4. An electrical connector as in claim 1 wherein the latches are deflectable in a third direction orthogonal to the first direction and orthogonal to the second direction.

5. An electrical connector as in claim 1 wherein the TPA member is located at a mating connector face of the electrical connector.

6. An electrical connector as in claim 1 wherein the TPA member comprises cantilevered blocking projections comprising slots and thicker rail sections.

7. An electrical connector as in claim 1 wherein the TPA member comprises a leading face with male pin entry holes and test probe holes aligned in a third direction, and terminal service holes at least partially offset in the first direction from the aligned male pin entry holes and the test probe holes.

8. An electrical connector as in claim 1 wherein the TPA member comprises a leading face with male pin entry holes aligned in a third direction.

9. An electrical connector as in claim 8 wherein the TPA member comprises a leading face with terminal service holes at least partially offset in the first direction from the aligned male pin entry holes.

10. An electrical connector as in claim 1 wherein the TPA member comprises a leading face with test probe holes aligned in a third direction.

11. An electrical connector as in claim 10 wherein the TPA member comprises a leading face with terminal service holes at least partially offset in the first direction from the test probe holes.

12. An electrical connector housing comprising:

a first housing member comprising contact receiving areas and contact latches; and a second housing member forming a terminal position assurance (TPA) member movably connected to the first housing member, wherein the TPA member is slidably connected to the first housing between an unlocked position and a locked position, wherein in the unlocked position the TPA member allows the latches to move to a disengaged position with electrical contacts located in the contact receiving areas, and wherein in the locked position the TPA member prevents the latches from deflecting to the disengaged position, and wherein the TPA member is slidable on the housing between the unlocked position and the locked position in a first direction which is orthogonal to a second direction of insertion of the contacts into the housing, and which is orthogonal to a direction of connection of the electrical connector housing to a mating electrical connector, and which is generally orthogonal to a direction of initial insertion of the TPA member into the housing.

13. An electrical connector housing as in claim 12 wherein the TPA member is located at a mating connector face of the electrical connector.

14. An electrical connector housing as in claim 12 wherein the TPA member comprises cantilevered blocking projections comprising slots and thicker rail sections.

15. An electrical connector housing as in claim 12 wherein the TPA member comprises a leading face with male pin entry holes and test probe holes aligned in a third direction, and terminal service holes at least partially offset in the first direction from the aligned male pin entry holes and the test probe holes.

16. An electrical connector comprising:

the electrical connector housing as in claim 12; and electrical contacts located in the contact receiving areas.

17. An electrical connector housing as in claim 12 wherein the latches are resiliently deflectable cantilevered latches integrally formed with the housing.

18. An electrical connector housing as in claim 17 wherein the latches are deflectable in a third direction orthogonal to the first direction and orthogonal to the second direction.

19. An electrical connector comprising:

a housing comprising contact receiving areas and contact latches;

electrical contacts located in the receiving areas and retained with the housing by the latches; and a terminal position assurance (TPA) member movably connected to the housing, wherein the TPA member is slidably connected to the housing between an unlocked position and a locked position, wherein in the unlocked position the TPA member allows the latches to move to a disengaged position with the contacts, and wherein in the locked position the TPA member prevents the latches from deflecting to the disengaged position, and wherein the TPA member is slidable on the housing in a first direction between the unlocked position and the locked position, orthogonal to a different second direction of insertion of the contacts into the housing, wherein the latches are resiliently deflectable cantilevered latches which are adapted to deflect in a different third direction when the contacts are inserted into the receiving areas, and wherein the first direction is orthogonal to a different fourth direction of connection of the electrical connector to a mating electrical connector, wherein the fourth direction is a direction of initial insertion of the TPA member into the housing.

20. An electrical connector as in claim 19 wherein the TPA member is located at a mating connector face of the electrical connector.

21. An electrical connector as in claim 19 wherein the TPA member comprises cantilevered blocking projections comprising slots and thicker rail sections.

22. An electrical connector as in claim 19 wherein the TPA member comprises a leading face with male pin entry holes and test probe holes aligned in the third direction, and terminal service holes at least partially offset in the first direction from the aligned male pin entry holes and the test probe holes.

* * * * *